US007621378B2

(12) United States Patent
Kawai

(10) Patent No.: US 7,621,378 B2
(45) Date of Patent: Nov. 24, 2009

(54) SYSTEM FOR CONTROLLED OPERATION OF ELEVATOR IN CASE OF FIRE AND METHOD OF CONTROLLED OPERATION OF ELEVATOR IN CASE OF FIRE

(75) Inventor: Kiyoji Kawai, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 460 days.

(21) Appl. No.: 11/578,043

(22) PCT Filed: Feb. 14, 2005

(86) PCT No.: PCT/JP2005/002170

§ 371 (c)(1),
(2), (4) Date: Oct. 12, 2006

(87) PCT Pub. No.: WO2006/085386

PCT Pub. Date: Aug. 17, 2006

(65) Prior Publication Data

US 2007/0272497 A1 Nov. 29, 2007

(51) Int. Cl.
*B66B 13/02* (2006.01)

(52) U.S. Cl. ..... 187/313; 187/384; 187/387

(58) Field of Classification Search ..... 187/308–388, 187/391–396

See application file for complete search history.

(56) References Cited

U.S. PATENT DOCUMENTS

| | | | | |
|---|---|---|---|---|
| 5,979,607 | A * | 11/1999 | Allen | 187/390 |
| 7,182,174 | B2 * | 2/2007 | Parrini et al. | 182/18 |
| 7,461,723 | B2 * | 12/2008 | Kawai | 187/313 |
| 2007/0278044 | A1 * | 12/2007 | Hikita et al. | 187/247 |
| 2009/0038892 | A1 * | 2/2009 | Kawai et al. | 187/387 |

FOREIGN PATENT DOCUMENTS

| | | |
|---|---|---|
| JP | 50-90044 | 2/1977 |
| JP | 53-26028 | 7/1978 |
| JP | 53-82070 | 7/1978 |
| JP | 54-24783 | 8/1979 |
| JP | 58-52171 | 3/1983 |
| JP | 62-171880 | 7/1987 |
| JP | 4-354789 | 12/1992 |
| JP | 6-16357 | 1/1994 |
| JP | 7-25560 | 1/1995 |
| JP | 8-2861 | 1/1996 |
| JP | 10-53379 | 2/1998 |
| JP | 2002-509850 | 4/2002 |
| JP | 2004-206323 | 7/2004 |
| WO | WO 2004/101418 A1 | 11/2004 |
| WO | WO 2005/121004 A1 | 12/2005 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

A fire emergency control operation system for an elevator includes an evacuation time calculator for acquiring a positional relationship between the elevator and the fire sensor which performs the fire detecting operation based upon information from the fire sensor to calculate an evacuation operation time based upon the obtained positional relationship; a fire occurrence floor specifier for specifying a fire occurrence floor based upon the information from the fire sensor; and a remaining person count input device for inputting a number of the remaining persons in correspondence with each of the floors. There is a schedule decider for deciding an evacuation operation schedule for the respective floors when the remaining persons are conveyed to the evacuation floor based upon the information from the evacuation time calculating means, the fire occurrence floor specifier, and the remaining person count input device; a display for displaying thereon a content of the evacuation operation schedule; and an elevator controller for controlling the operation of the elevator based upon the information of the evacuation operation schedule.

12 Claims, 14 Drawing Sheets

FIG. 5

EVACUATION OPERATION SCHEDULE FOR HIGH-FLOOR BANK

・FIRE OCCURRENCE FLOOR: 25TH FLOOR
・TRAIN TYPE OPERATION MODE
・EVACUATION FLOOR: FIRST FLOOR
・EVACUATION OPERATION TIME: 22 MINUTES

| RESCUE ORDER | RESCUE TARGET FLOOR | REMAINING PERSONS | RESCUE COUNT | WAITING TIME | COMPLETED |
|---|---|---|---|---|---|
| 1 | 26TH FLOOR | 100 PERSONS | 1 TIME | 3 MINUTES | UNCOMPLETED |
| 2 | 27TH FLOOR | 120 PERSONS | 2 TIMES | 9 MINUTES | UNCOMPLETED |
| 3 | 28TH FLOOR | 80 PERSONS | 1 TIME | 12 MINUTES | UNCOMPLETED |
| 4 | 29TH FLOOR | 200 PERSONS | 2 TIMES | 18 MINUTES | UNCOMPLETED |
| 5 | 30TH FLOOR | 100 PERSONS | 1 TIME | 21 MINUTES | UNCOMPLETED |

STAIRCASE EVACUATION TARGET FLOOR: 25TH FLOOR TO 20TH FLOOR

FIG. 6

EVACUATION OPERATION SCHEDULE FOR HIGH-FLOOR BANK

・FIRE OCCURRENCE FLOOR: 29TH FLOOR
・TRAIN TYPE OPERATION MODE
・EVACUATION FLOOR: FIRST FLOOR
・EVACUATION OPERATION TIME: 22 MINUTES

| RESCUE ORDER | RESCUE TARGET FLOOR | REMAINING PERSONS | RESCUE COUNT | WAITING TIME | COMPLETED |
|---|---|---|---|---|---|
| 1 | 30TH FLOOR | 100 PERSONS | 1 TIME | 3 MINUTES | UNCOMPLETED |
| 2 | 28TH FLOOR | 80 PERSONS | 1 TIME | 6 MINUTES | UNCOMPLETED |
| 3 | 27TH FLOOR | 120 PERSONS | 2 TIMES | 12 MINUTES | UNCOMPLETED |
| 4 | 26TH FLOOR | 100 PERSONS | 1 TIME | 15 MINUTES | UNCOMPLETED |
| 5 | 25TH FLOOR | 60 PERSONS | 1 TIME | 18 MINUTES | UNCOMPLETED |
| 6 | 24TH FLOOR | 80 PERSONS | 1 TIME | 21 MINUTES | UNCOMPLETED |

STAIRCASE EVACUATION TARGET FLOOR:
29TH FLOOR AND 23TH FLOOR TO 20TH FLOOR

SYSTEM FOR CONTROLLED OPERATION OF ELEVATOR IN CASE OF FIRE AND METHOD OF CONTROLLED OPERATION OF ELEVATOR IN CASE OF FIRE

TECHNICAL FIELD

The present invention relates to a fire emergency control operation system for an elevator which is used to evacuate persons remaining in a building when a fire breaks out in the building, and a fire emergency control operation system therefor.

TECHNICAL BACKGROUND

Conventionally, there has been proposed an elevator control operation system in which an operation of the elevator is controlled in such a manner that an elevator car can be stopped only on a fire alarm operating floor and a predetermined evacuation floor for a time period between when the operation of the fire alarm is detected and when a predetermined operation control condition is satisfied. In the conventional elevator control operation system, after the predetermined operation condition is satisfied, the elevator car is returned to the evacuation floor and stopped thereon (refer to Patent Document 1).

Patent Document 1: JP 58-52171 A

DISCLOSURE OF THE INVENTION

Problem to be Solved by the Invention

However, in the conventional elevator control operation system, remaining persons on floors other than the fire alarm operating floor cannot be conveyed to the evacuation floors. As a result, these remaining persons cannot be conveyed to the evacuation floors with high efficiency.

The present invention has been made to solve the above-mentioned problem, and therefore has an object to provide a fire emergency control operation system for an elevator capable of rescuing persons remaining in a building with higher efficiency when a fire breaks out in the building, and a fire emergency control operation method for an elevator.

Means for Solving the Problems

A fire emergency control operation system for an elevator according to the present invention is a system in which when a fire sensor installed in a building having a plurality of floors, detects a fire, remaining persons within the building are conveyed to an evacuation floor through an evacuation operation of the elevator provided in the building, and is characterized by including:

evacuation time calculating means for obtaining a positional relationship between the elevator and the fire sensor which performs the fire detecting operation based upon information from the fire sensor to calculate an evacuation operation time based upon the obtained positional relationship;

fire occurrence floor specifying means for specifying a fire occurrence floor based upon the information from the fire sensor;

remaining person count input means for inputting a number of the remaining persons in correspondence with each of the floors;

schedule deciding means for deciding an evacuation operation schedule for the respective floors when the remaining persons are conveyed to the evacuation floor based upon the information from the evacuation time calculating means, the fire occurrence floor specifying means, and the remaining person count input means;

display means for displaying thereon a content of the evacuation operation schedule; and elevator control means for controlling the operation of the elevator based upon the information of the evacuation operation schedule.

BRIEF DESCRIPTION OF THE DRAWINGS

FIG. 5 An explanatory diagram explaining an example as to contents of an evacuation operation schedule displayed on a display unit shown in FIG. 4.

FIG. 6 An explanatory diagram explaining another example as to the contents of the evacuation operation schedule displayed on the display unit shown in FIG. 4.

BEST MODE FOR CARRYING OUT THE INVENTION

Referring now to drawings, preferred embodiments of the present invention will be described.

FIRST EMBODIMENT

Figure 1:
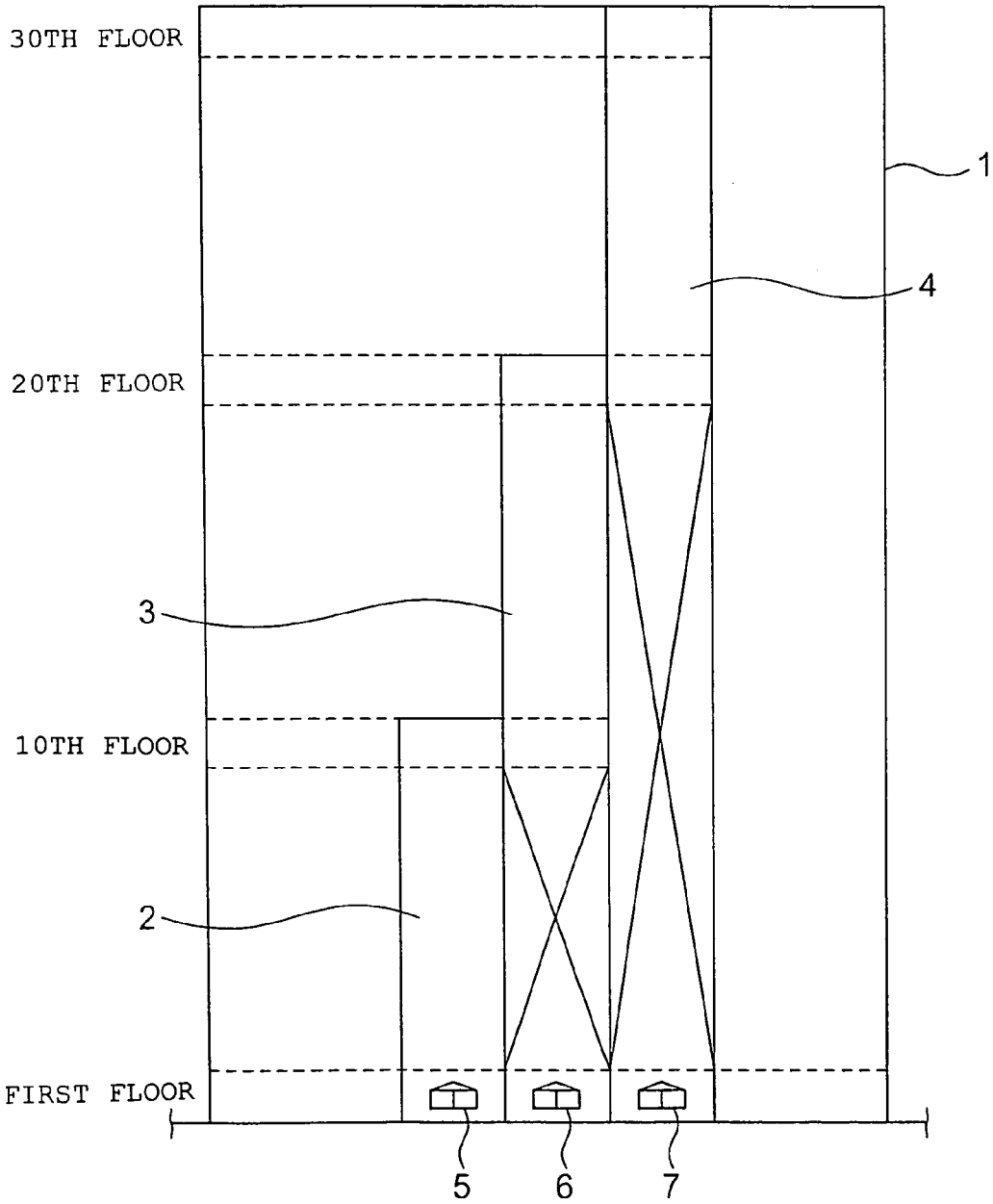
FIG. 1 A structural diagram schematically showing a building to which a fire emergency control operation system of an elevator according to a first embodiment of the present invention is applied.

FIG. 1 is a structural diagram schematically showing a building to which a fire emergency control operation system of an elevator according to a first embodiment of the present invention is applied. In the drawing, an elevator 2 of a lower bank, an elevator 3 of a middle bank, and an elevator 4 of a higher bank are installed in a building 1 including a plurality of floors. The building 1 is a high-rise building of 30 floors, which includes a basement (not shown). The elevator 2 of the lower bank includes an elevator car 5 which can be stopped at each of a first floor to 10th floor. The elevator 3 of the middle bank includes an elevator car 6 which can be stopped at each of the first floor and from the 10th floor to 20th floor. The elevator 4 of the higher bank includes an elevator car 7 which can be stopped at each of the first floor and the 20th floor to 30th floor. Further, both the 10th floor and the 20th floor are used as connection floors.

Figure 2:
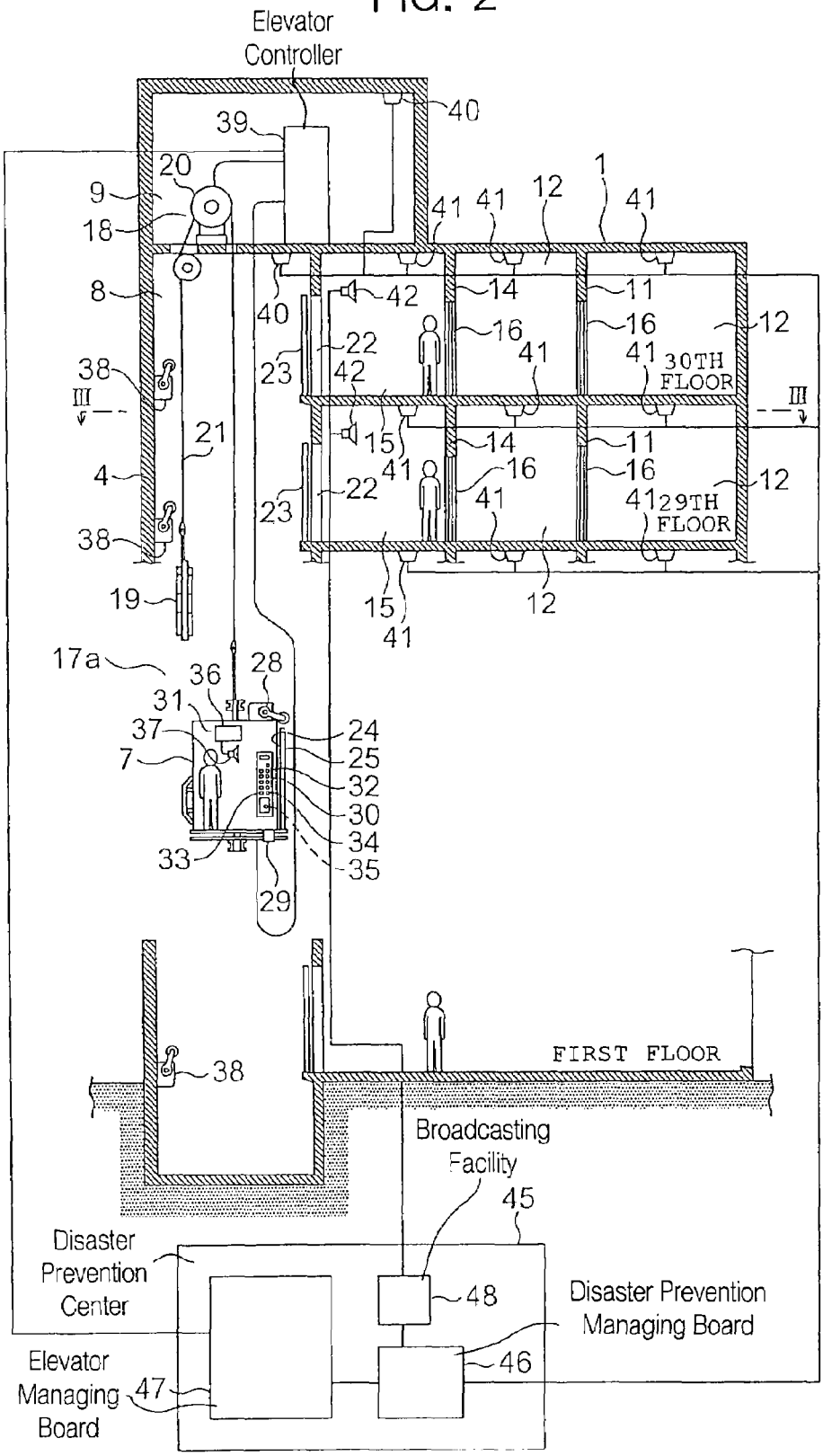
FIG. 2 A longitudinal sectional view showing a major portion of the building of FIG. 1.
Figure 3:
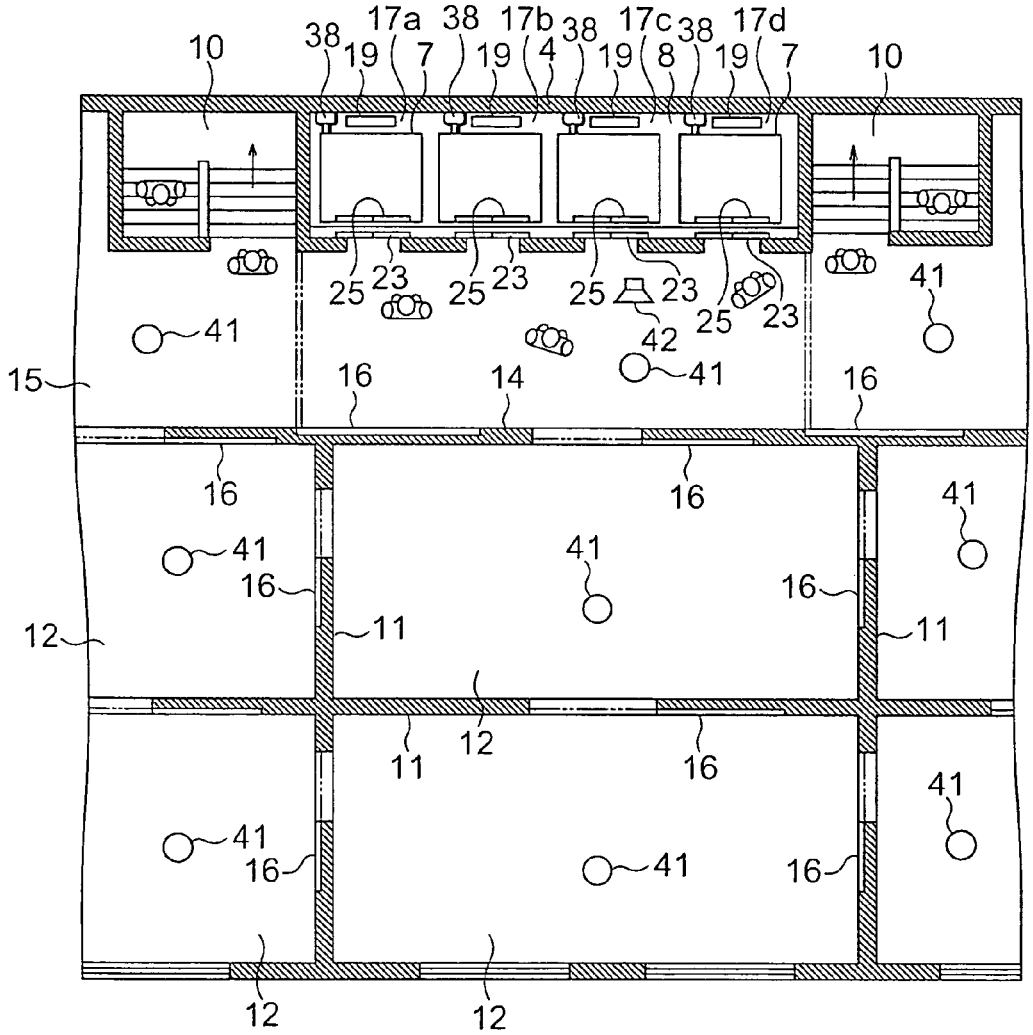
FIG. 3 A sectional view of the building taken along the line III-III of FIG. 2.
Figure 4:
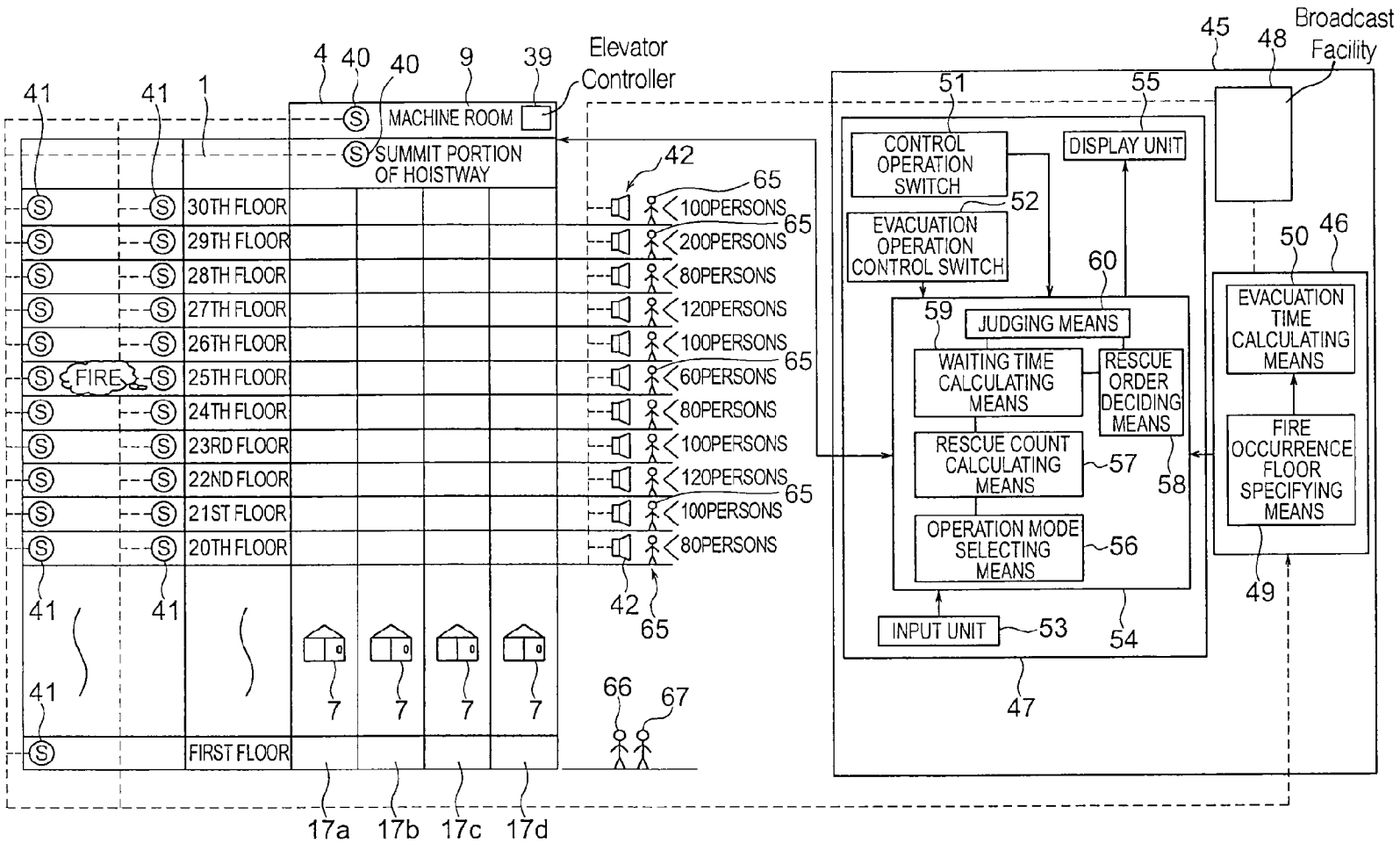
FIG. 4 A schematic block diagram representing the fire emergency control operation system of the elevator according to the first embodiment of the present invention.

FIG. 2 is a longitudinal sectional view showing a major portion of the building of FIG. 1. Also, FIG. 3 is a sectional view of the building taken along the line III-III of FIG. 2. Further, FIG. 4 is a schematic block diagram representing the fire emergency control operation system of the elevator. For the sake of an easy understanding, both the elevator 2 of the lower bank and the elevator 3 of middle bank are omitted, which are indicated in FIG. 1. Hereinafter, both a structure and operations of the elevator 4 will be described. Structures and operations of the elevators 2 and 3 are similar to those of the elevator 4, so explanations thereof are omitted. In the drawings, a hoistway 8, a machine room (FIG. 2 and FIG. 4) arranged at an upper portion of the hoistway 8, and a pair of emergency staircases 10 (FIG. 3) are provided. The pair of emergency staircases 10 are arranged in such a manner that these emergency staircases 10 sandwich the hoistways 8 within a horizontal plane, and are used in order that persons move among the respective floors.

A plurality of rooms 12 which are partitioned by partition walls 11, and an elevator hall 15 located adjacent to the elevator 4 are provided in each of the floors (second floor to 30th floor). The elevator hall 15 is located adjacent to one of the rooms 12, and is partitioned from these rooms 12 by a partition wall 14. Fire doors 16 capable of preventing fire spreads or the like when a fire breaks out are provided on the partition walls 11 and 14. For the first floor, a fire resistant measure has been made and designed as an evacuation floor which is used for evacuation when the fire breaks out. It should be noted that the connection floors may be used as the evacuation floor.

The elevator 4 of the higher bank includes a first elevator machine 17*a* to a fourth elevator machine 17*d* (a plurality of elevator machines 17*a* to 17*d*) which are arranged side by side along a horizontal direction (FIG. 3 and FIG. 4). Each of the elevator machines 17*a* to 17*d* includes a hoisting machine 18 installed in the machine room 9, a car 7, and a balancing weight 19. The car 7 and the balancing weight 19 are moved within the hoistway 8 by receiving drive force of the hoisting machine 18. A main rope 21 for suspending the car 7 and the balancing weight 19 is wound on a drive sheave 20 of each of the hoisting machines 18. Both the car 7 and the balancing weight 19 are move within the hoistway 8 by rotations of the drive sheave 20.

Each of the elevator machines 17*a* to 17*d* is provided with a plurality of elevator hall entrances 22 which communicate the elevator halls 15 of the respective floors with the inside of the hoistway 8, and doors 23 of the elevator halls, which open/close the respective elevator hall entrances 22. Also, each of the cars 7 is provided with a car entrance 24 and a door 25 of the car which opens/closes the car entrance 24. Also, a door driving unit (not shown) which drives the door 25 of the car is mounted on each of the cars 7.

When the car 7 lands at the respective floors, the door 25 of the car is moved along with the door 23 of the elevator halls by the driving force of the door driving unit, so that the elevator hall entrance 22 and the car entrance 24 are opened/closed. It should be noted that an elevator entrance which communicates the elevator hall 15 with the inside of the car 7 includes the elevator hall entrance 22 and the car entrance 24. Also, an elevator door which opens/closes the elevator entrance includes the door 23 of the elevator hall and the door 25 of the car 7.

A door switch 28 is provided on an upper portion of each of the cars 7. The door switch 28 detects that the door closing operation of the elevator entrance is finished. Also, a scaling apparatus 29 is provided on a lower portion of each of the cars 7, and the scaling apparatus 29 detects weight within the car 7. Further, both a car operation board 30 and an in-car notifying apparatus 31 are provided inside each of the cars 7 (FIG. 2).

Each of the car operation boards 30 is provided with a plurality of destination floor buttons 32, a door open button (operation button) 33, and a door close button (operation button) 34, for opening and closing the elevator entrance. Also, each of the car operation boards 30 is provided with an evacuation operation in-car switch 35, which is operable by opening a lid thereof. The in-car notifying apparatus 31 includes an in-car display apparatus (display means) 36 for displaying information inside the car 7, and an in-car speaker 37 for notifying information inside the car 7 by way of voice (FIG. 2). It should also be noted that a plurality of car position switches 38 are provided in the hoistway 8, for detecting that each of the cars 7 has landed on each of the elevator halls 15.

An elevator controller (elevator control means) 39 for controlling operations of the elevator 4 is provided in the machine room 9. The elevator controller 39 controls operations of the respective elevator machines 17*a* to 17*d* in a collective manner. To the elevator controller 39, the hoisting machine 18, the door driving unit, the door switch 28, the scaling apparatus 29, the car operation board 30, the in-car notifying apparatus 31, and the car position switch 38 of each of the elevator machines 17*a* to 17*d* are electrically connected, respectively.

A fire sensor 40 within the elevator for sensing a fire is installed in a summit portion of the hoistway 8 and in the machine room 9, respectively. Also, an in-building fire sensor 41 for sensing a fire is installed in each of the elevator halls 15 and each of the rooms 12, respectively.

An elevator hall speaker 42 is provided in each of the elevator halls 15 as an elevator hall notification apparatus. The elevator hall speaker 42 notifies information by way of voice to the respective elevator halls 15.

A disaster prevention center (central managing room) 45 is placed at the basement of the building 1 (FIG. 2 and FIG. 4) in order that the disaster prevention center 45 monitors and controls facility appliances related to disaster prevention in a concentrated manner. The disaster prevention center 45 is equipped with a disaster prevention managing board 46 for monitoring whether or not a fire has broken out in the building 1; an elevator managing board 47 for monitoring operations of the elevators 2 to 4 based upon information from the disaster prevention managing board 46; and a broadcasting equipment 48 electrically connected to the disaster prevention managing board 46. As the elevator managing board 47, for instance, a personal computer and the like is employed. In descriptions given below, since explanations as to operation management of the elevator managing board 47 is similar to that of any of the elevators 2 to 4, only the operation management with respect to the elevator 4 will be described.

The broadcasting equipment 48 may provide to the respective elevator halls 15 information obtained by the disaster prevention center 45. The information obtained in the disaster prevention center 45 is notified via the respective elevator hall speakers 42 to the respective elevator halls 15.

In the disaster prevention managing board 46, positional information of the respective fire sensors 40 within the elevator within the building 1 and the respective in-building fire sensors 41 have been previously stored as fire sensor positional information. Also, information as to whether or not fire detecting operations are performed for the respective fire sensors 40 within the elevator and the in-building fire sensors 41 is designed to be entered through the disaster prevention managing board 46 as fire sensor operating information, in a serial communication manner. Further, the disaster prevention managing board 46 is equipped with a fire occurrence floor specifying means 49 and an evacuation time calculating means 50.

The fire occurrence floor specifying means 49 judges whether or not a fire has occurred based upon both the fire sensor positional information and the fire sensor operating information, and also specifies a floor where the fire has occurred. In other words, the fire occurrence floor specifying means 49 judges that a fire has occurred within the building 1 when at least one of the fire sensors 40 and 41 detects a fire, whereas the fire occurrence floor specifying means 49 judges that the fire has not broken out within the building 1 when the fire detecting operation of any one of the fire sensors 40 and 41 is not entered to the disaster prevention managing board 46. Further, the fire occurrence floor specifying means 49 specifies the floor, at which the fire sensors 40 and 41 that have detected the fire are provided, as the fire occurrence floor.

The evacuation time calculating means 50 acquires a positional relationship between the fire sensor which has performed a fire detecting operation and the elevator 4 based upon the fire sensor positional information and the fire sensor operating information, and then, calculates an evacuation operation time based upon this obtained positional relationship. In other words, the evacuation time calculating means 50 calculates a distance from a position of the in-building fire sensor 41 which has performed the fire detecting operation up to the position of the elevator 4, and then, calculates an evacuation operation time based upon this calculated distance. Alternatively, the evacuation time calculating means 50 may calculate a time difference of fire detecting operation among the respective in-building fire sensors 41, namely, propagation times (flame strengths) of flames, and then, may calculate an evacuation operation time based upon the obtained propagation times. In this case, the above-mentioned evacuation operation time corresponds to a time during which the elevator 4 can be operated in order to convey a person remaining within the building 1 to an evacuation floor when a fire breaks out. It should be understood that when the fire detecting operation of the fire sensor 40 within the elevator is inputted to the disaster prevention managing board 46, since the fire has occurred in the elevator 4, it is so designed that the evacuation time calculating means 50 calculates an evacuation operation time as zero.

From the fire prevention managing board 46, the information as to the fire occurrence floor, the information as to the evacuation operation time, the fire sensor positional information, and the fire sensor operating information are entered to the elevator managing board 47 in the serial communication manner. Also, information as to a specification of the elevator 4 and information as to a rescue order algorithm have been previously stored in the elevator managing board 47. The rescue order algorithm is used to give priorities with respect to the respective floors where remaining persons are present. As the specification of the elevator 4, for example, a total number of elevator machines (in this example, 4 sets of first elevator machine 17*a* to fourth elevator machine 17*d*); a rated speed (in this example, 300 m/min); a capacity of each of the cars 7 (in this example, 24 persons); stoppable floors of the car 7 (in this case, first floor and 20th floor to 30th floor) have been employed.

The elevator managing board 47 is provided with a control switch 51 for selecting whether or not a control operation of the elevator 4 is applied, and an evacuation operation control switch 52 for selecting whether or not an evacuation operation of the elevator 4 is applied. In this case, the above-mentioned control operation of the elevator 4 corresponds to an operation of the elevator 4 performed by managing/controlling the control operation of the elevator controller 39 by the elevator managing board 47. Also, the above-mentioned evacuation operation of the elevator 4 corresponds to a control operation of the elevator 4 performed in order that a person remaining in the building 1 is conveyed to an evacuation floor. Further, the evacuation operations of the elevator 4 can be selectively switched between a train type operation mode and a taxi type operation mode. In the train type operation mode, the cars 7 in all of the elevator machines 17*a* to 17*d* are raised/lowered all together. In the taxi type operation mode, only the car 7 in any one of the elevator machines 17*a* to 17*d* is raised/lowered.

The elevator managing board 47 includes an input unit (remaining person input means) 53, a processing unit (schedule scheduling means) 54, and a display unit (display means) 55. The input unit 53 inputs a total number of persons remaining in the building 1 as remaining person information in correspondence with the respective floors. The processing unit 54 schedules an evacuation operation schedule with respect to the respective floors based upon the information from the disaster prevention managing board 46, the elevator controller 47, and the input unit 53, the evacuation operation schedule being used when the remaining persons are conveyed to the evacuation floor by the evacuation operation of the elevator 4. The display unit 55 displays a content of the evacuation operation schedule. As the input unit 53, for example, an operation input apparatus such as a keyboard is employed. Also, as the display unit 55, for example, a liquid crystal display and the like are employed.

Also, a bi-directional communication can be performed by the serial communication method between the elevator managing board 47 and the elevator controller 39. From the elevator controller 39, weight information from each of the scaling apparatus 29, information as to a landing number of each of the cars 7 at the evacuation floor during the evacuation operation, and the evacuation operation information obtained by manipulating the evacuation operation in-car switch 35 are inputted to the elevator managing board 47. Also, from the elevator managing board 47, evacuation operation application information obtained by the control switch 51 and the evacuation operation control switch 52, mode selection information for selecting one of the train type operation mode and the taxi type operation mode, and the information as to the evacuation operation schedule are inputted to the elevator controller 39.

The processing unit 54 includes an operation mode selecting means 56, a rescue count calculating means 57, a rescue order deciding means 58, a waiting time calculating means 59, and a judging means 60.

The operation mode selecting means 56 selects one of the train type operation mode and the taxi type operation mode based upon the remaining person information. In other words, the operation mode selecting means 56 selects the taxi type operation mode when a total number of the remaining persons in each of the floors is smaller than the number obtained by multiplying 1.1 with the capacity of the car 7 (normally, the car 7 can accept passengers whose number does not exceed 110% of capacity), whereas the operation mode selecting means 56 selects the train type operation mode when a total number of the remaining persons in each of the floors is equal to or larger than the number obtained by multiplying 1.1 with the capacity of the car 7.

The rescue count calculating means 57 calculates a total rescue count (namely, total number of landings by the car 7 on each floor) which is required for rescuing a remaining person based upon the remaining person information and the operation mode selecting means 56. In other words, in the case where the train type operation mode is selected by the operation mode selecting means 56, the rescue count calculating means 57 calculates a total rescue count in each of the floors in such a manner that a total number of persons remaining on each of the respective floors is divided by a number obtained by multiplying a total number of the capacities of all of the cars 7 by 1.1. Also, in the case where the taxi type operation mode is selected by the operation mode selecting means 56, the rescue count calculating means 57 sets a total rescue count in each of the floors as 1.

The rescue order deciding means 58 determines priorities of the respective floors by a method defined by the rescue order algorithm, based upon information of a fire occurrence floor. In other words, the rescue order deciding means 58 determines the priorities of the respective floors based upon the positional relationship between the fire occurrence floor and the respective floors. Also, when the fire sensor 40 within the elevator detects a fire, the rescue order deciding means 58 stops determination of the rescue order.

The waiting time calculating means 59 calculates a waiting time at each of the floors based upon information from the rescue time calculating means 57 and the rescue order deciding means 58. In other words, the waiting time calculating means 59 adds time required for a rescue to each of the floors in an ascending order from a floor having a highest priority, thereby calculating the waiting time at each of the floors.

The judging means 60 judges both a rescue target floor from which a remaining person is rescued, and a rescue prohibited floor in which a rescue of a remaining person is prohibited with respect to the respective floors, based upon the information of the evacuation operation time, the information from the rescue order deciding means 58, and the information from the waiting time calculating means 59. In other words, the judging means 60 judges that a floor whose waiting time is equal to or shorter than the evacuation operation time corresponds to the rescue target floor, whereas the judging means 60 judges that a floor whose waiting time is longer than the evacuation operation time corresponds to the rescue prohibited floor. It should be understood that the rescue prohibited floor is set as a staircase evacuation target floor where an evacuation is carried out by using the emergency staircases 10.

The processing unit 54 may update remaining person information by inputting again the remaining person information by using the input unit 5. Also, the processing unit 54 may calculate a total number of remaining persons conveyed to an evacuation floor based upon weight information obtained from the scaling apparatus 29 and information as to a car landing number, and may update the remaining person information based upon the calculated total number of the remaining persons. Also, the processing unit 54 may update a rescue count based upon information as to a total landing number to an evacuation floor. Further, the processing unit 54 may update a waiting time based upon information as to a total landing number to an evacuation floor.

That is, the processing unit 54 may update a content of an evacuation operation schedule based upon both the remaining person information entered from the input unit 53 and the information from the elevator controller 39. Also, both the display unit 55 and the in-car display apparatus 36 display a content of a latest evacuation operation schedule updated by the processing unit 54.

Here, FIG. 5 is an explanatory diagram for explaining one example of contents of an evacuation operation schedule which is displayed on the display unit 55 shown in FIG. 4. Also, FIG. 6 is an explanatory diagram for explaining another example of contents of an evacuation operation schedule which is displayed on the display unit 55 shown in FIG. 4. It should be understood that FIG. 5 shows an example of the contents of the evacuation operation schedule in the case where a fire occurrence floor is specified on a 25th floor, and an evacuation operation time is calculated as 22 minutes. Also, FIG. 6 shows an example of the contents of the evacuation operation schedule in the case where a fire occurrence floor is specified on a 29th floor, and an evacuation operation time is calculated as 22 minutes.

As shown in the drawings, the display unit 55 displays thereon a rescue order, a total number of remaining persons, a rescue count, awaiting time, and completion/incompletion of a rescue based upon information from the processing unit 54 with respect to each of rescue target floors. Also, the display unit 55 displays thereon a fire occurrence floor, an evacuation floor, an operation mode, and an evacuation operation time, and also displays each of the rescue prohibited floors as a staircase evacuation target floor. That is, the evacuation operation schedule includes various sorts of information, namely, the rescue order, the total number of remaining persons, the rescue count, the waiting time, and the completion/incompletion of the rescue, the fire occurrence floor, the evacuation floor, the operation mode, the evacuation operation time, and the staircase evacuation target floor, with respect to each of the rescue target floors.

It should also be noted that when a fire breaks out in each of the floors in the higher bank, as of evacuation operations in both the lower bank elevator 2 and the middle bank elevator 3, the evacuation operation is sequentially carried out from the uppermost floor of each bank to the lower floor thereof within the range of the evacuation operation time.

When the evacuation operation is being carried out, the elevator controller 39 controls operations of the elevator 4 based upon the information of the evacuation operation schedule which is decided by the processing unit 54. Also, the elevator controller 39 displays the contents of the evacuation operation schedule on each of the in-car display apparatuses 36, and notifies those in the car the contents of the evacuation operation schedule by way of the in-car speaker 37.

The elevator controller 39 specifies any one of the respective elevator machines 17*a* to 17*d* as an instructed elevator machine by manipulating the evacuation operation in-car switch 35. Also, in the case of the train type operation mode, the elevator controller 39 controls the operations of all the elevator machines 17*a* to 17*d* based upon a manipulation of the door close button 34 of the car 7 in the instructed elevator machine. In the case of the taxi type operation mode, the elevator controller 39 controls only the operation of the instructed elevator machine based upon manipulations of both the door open button 33 and the door close button 34 within the car 7 in the instructed elevator machine.

Also, the elevator controller 39 controls operations of an elevator in such a manner that both a door opening operation and a door closing operation of an elevator entrance are carried out only when a landing operation of the car 7 on a rescue target floor is completed, and further, only when both the door open button 33 and the door close button 34 provided in the car 7 of the instructed elevator machine are manipulated. Further, the elevator controller 39 controls the operations of the elevators in the train type operation mode in the following manner: when the car 7 is kept landed on the rescue target floor, the elevator controller 39 executes the door opening operation of the elevator entrance of the instructed elevator machine based upon the manipulation of the door open button 33 of the instructed elevator machine; and after the door closing operation thereof has been finished, the elevator controller 39 performs door closing operations of the elevator entrances of elevator machines other than the instructed elevator machine. Further, the elevator controller 39 controls the operations of the elevators in the taxi type operation mode in the following manner: when the car 7 is kept landed on the rescue target floor, the elevator controller 39 executes the door closing operations of the elevator entrances of elevator machines other than the instructed elevator machine based upon the manipulation of the door close button 34 of the instructed elevator machine; and after the door closing operation thereof has been finished, the elevator controller 39 performs door closing operation of the elevator entrance of the instructed elevator machine.

It should also be noted that when a service interruption occurs while an evacuation operation is carried out, the elevator controller 39 may control the operations of the elevators, since electric power is supplied by a battery (battery apparatus). Also, in the case where the service interruption occurs and where the fire sensor 40 within the elevator detects a fire during the evacuation operation, the elevator controller 39 controls the operations of the elevator 4 in such a manner that the car 7 lands on a nearest floor (i.e., nearest floor where car 7 can be landed) located lower than the fire occurrence floor.

Figure 7:
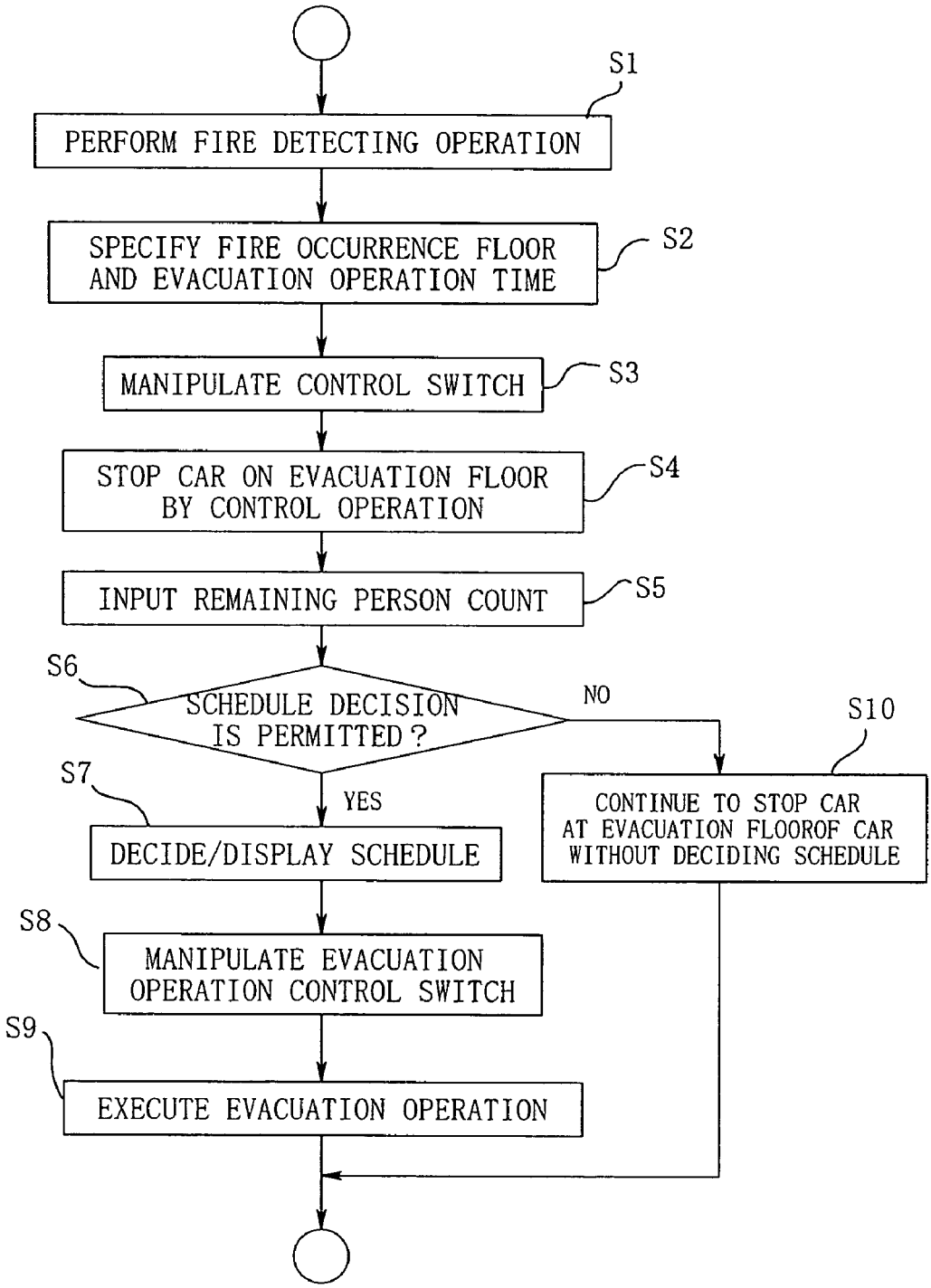
FIG. 7 A flow chart explaining operations of the fire emergency control operation system of the elevator shown in FIG. 4.

Next, a description is made of operations as to the fire emergency control operation system of the elevator. FIG. 7 is a flow chart explaining operations as to the fire emergency control operation system of the elevator shown in FIG. 4. As indicated in the drawing, when any one of the fire sensors 40 and 41 executes a fire detecting operation (step S1), both a fire occurrence floor and an evacuation operation time are specified by the disaster prevention managing board 46 (step S2).

Also, when the control switch 51 is manipulated (step S3), an operation of the elevator 4 is set to the normal control operation by the elevator managing board 47. As a result, the respective cars 7 are raised/lowered to the evacuation floors, and are then stopped on the evacuation floors (step S4).

After that, when a total number of remaining persons is inputted to the input unit 53 (step S5), the processing unit 54 judges whether or not a scheduling operation of an evacuation operation schedule is possible based upon the respective information as to the fire occurrence floor, the evacuation operation time, and the total number of the remaining persons (step S6). In the case where the scheduling operation of the evacuation operation schedule is possible, the evacuation operation schedule is decided by the processing unit 54, and the content of the evacuation operation schedule is displayed on the display unit 55 (step S7). After that, when the evacuation operation control switch 52 is manipulated (step S8), the evacuation operation of the elevator 4 is allowed, so the elevator 4 is operated in the evacuation operation mode by the elevator controller 39 based upon the information of the evacuation operation schedule (step S9).

In the case where the scheduling operation of the evacuation operation schedule is not possible, the evacuation operation schedule is not decided by the processing unit 54, and a standby state of the respective cars 7 at the evacuation floors are continued (step S10).

Figure 8:
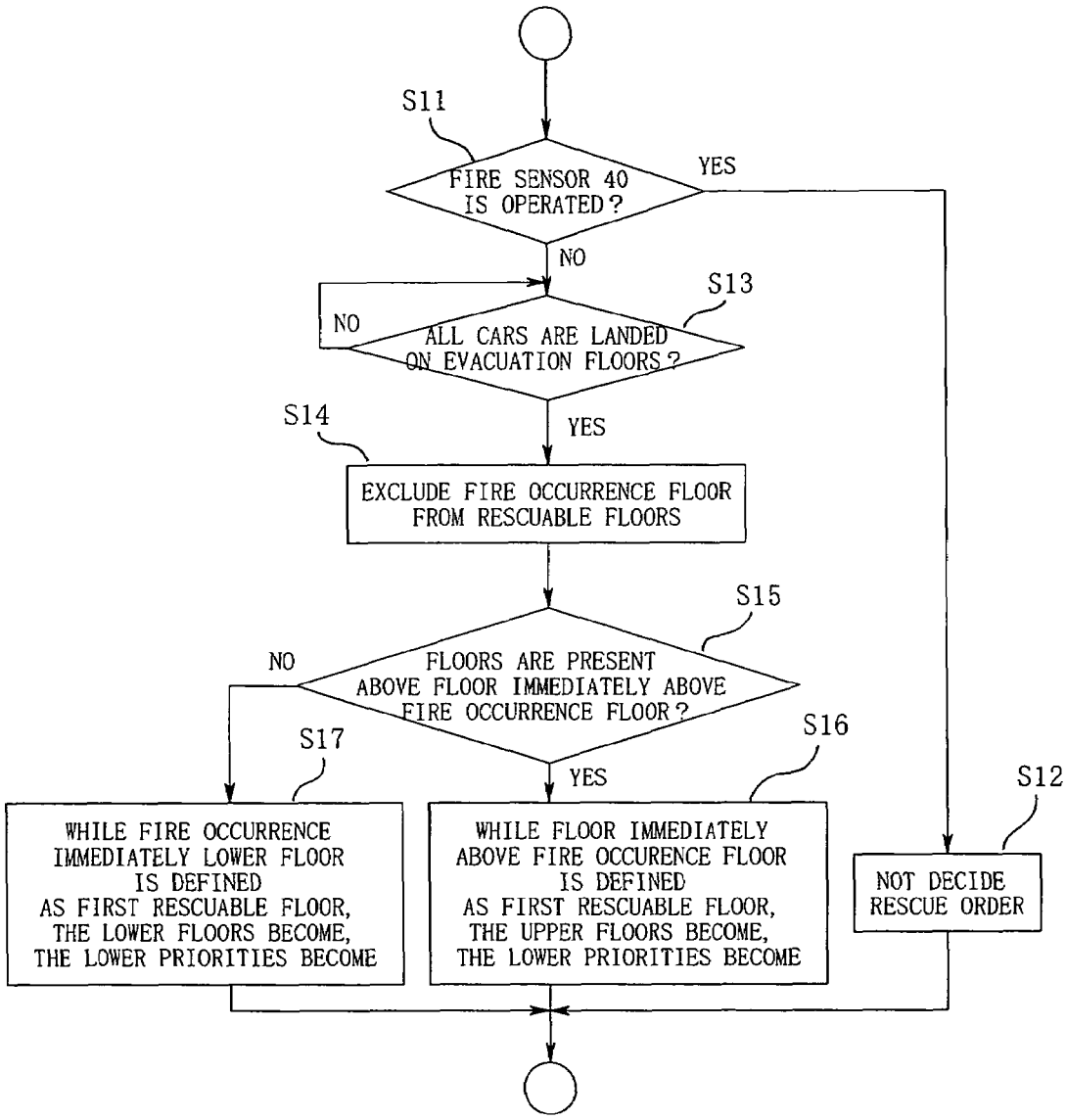
FIG. 8 A flow chart explaining a process operation executed in a rescue order deciding means of FIG. 4.

Next, a description is made of a method of deciding a rescue order in an evacuation operation. FIG. 8 is a flow chart explaining a process operation executed by the rescue order deciding means 58 of FIG. 4. As shown in the drawing, first, the rescue order deciding means 58 judges whether or not the fire sensor 40 within the elevator is performing a fire detecting operation (step S11). In the case where the fire sensor 40 within the elevator is performing the fire detecting operation, the rescue order deciding means 58 does not decide a rescue order for each of the floors (step S12).

In the case where the fire sensor 40 within the elevator is not performing the fire detecting operation, the rescue order deciding means 58 judges whether or not landing operations of the respective cars 7 on the evacuation floors have been completed by the control operation based upon the information from the elevator controller 39 (step S13). In the case where the landing operations of the cars 7 on the evacuation floors have not yet been completed, the rescue order deciding means 58 repeatedly judges whether or not the landing operations of the cars 7 on the evacuation floors have been completed.

In the case where the landing operations of the cars 7 on the evacuation floors have been completed, the rescue order deciding means 58 excludes the fire occurrence floor from a rescuable floor as a rescue order decision excluding floor (step S14). After that, the rescue order deciding means 58 judges whether or not a floor is present above the fire occurrence floor based upon the specification of the elevator (step S15). In the case where there are floors above the fire occurrence floor, the rescue order deciding means 58 decides a rescue order of the respective rescuable floors in such a manner that a floor which is located immediately above the fire occurrence floor and adjoins to the fire occurrence floor (i.e., floor immediately above the fire occurrence floor) is a first rescuable floor having the highest priority, and that the higher the floor is above the first rescuable floor, the lower the priority becomes (step S16).

In the case where there is no floor above the fire occurrence floor, the rescue order deciding means 58 decides a rescue order of the respective rescuable floors in such a manner that a floor which is located right below the fire occurrence floor and adjoins to the fire occurrence floor (i.e., immediately lower floor of the fire occurrence floor) is a first rescuable floor having the highest priority, and that the lower the floor is below the first rescuable floor, the lower the priority becomes (step S17).

Figure 9:
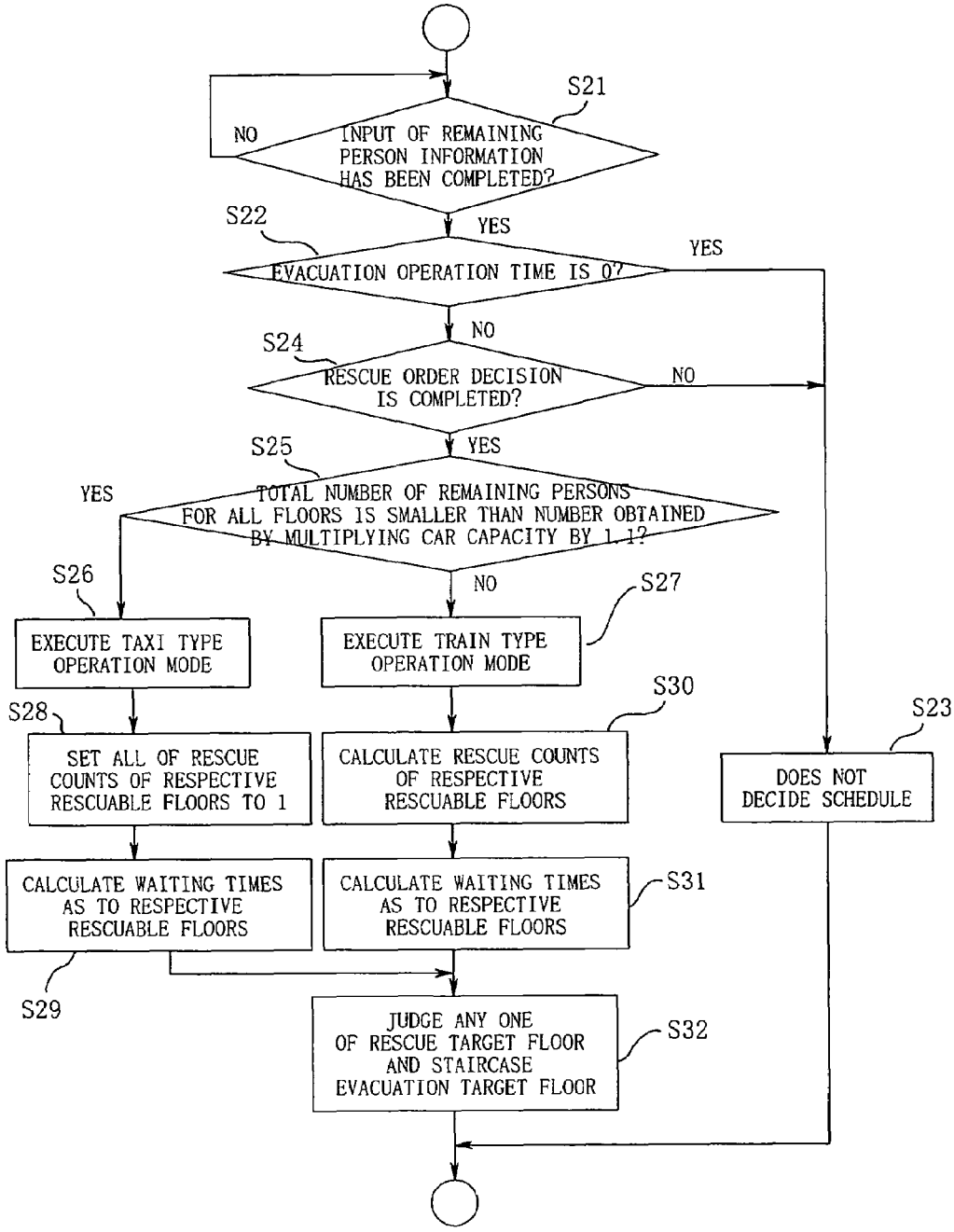
FIG. 9 A flow chart explaining a process operation performed in a processing unit of FIG. 4.

Next, a description is made of a method of deciding an evacuation operation schedule. FIG. 9 is a flow chart explaining a process operation performed by the processing unit 54 of FIG. 4. As shown in the drawing, the processing unit 54 first judges whether or not the remaining person information is entered from the input unit 53, the remaining person information corresponding to information as to a total number of remaining persons in each of the floors (step S21). When the remaining person information is not entered into the input unit 53, the processing unit 54 repeatedly judges whether or not the remaining person information is inputted until the remaining person information is inputted.

In the case where the input of the remaining person information to the input unit 53 is completed, the processing unit 54 judges whether or not an evacuation operation time is zero based upon the information from the disaster prevention managing board 46 (step S22). In the case where the evacuation operation time is zero, the processing unit 54 does not decide the evacuation operation schedule (step S23).

In a case where the evacuation operation time is not zero, the processing unit 54 judges whether or not the rescue order deciding means 58 has decided the rescue order (step S24). When the rescue order is not decided, the processing unit 54 does not decide the evacuation operation schedule (step S23).

In the case where the rescue order is decided, the operation mode selecting means 56 judges whether or not a total number of remaining persons in each of the rescuable floors is smaller than the number obtained by multiplying the capacity of the car 7 by 1.1 (step S25). The operation mode selecting means 56 selects the taxi type operation mode when a total number of the remaining persons in all of the rescuable floors is smaller than the number obtained by multiplying the capacity of the car 7 by 1.1 (step S26), whereas the operation mode selecting means 56 selects the train type operation mode when a total number of the remaining persons in at least any one of the rescuable floors is equal to or larger than the number obtained by multiplying the capacity of the car 7 by 1.1 (step S27).

In the case of the taxi type operation mode, a total rescue count with respect to each of the rescuable floors is set to be 1 by the rescue time calculating means 57 (step S28). After that, a waiting time with respect to each of the rescuable floors is calculated by the waiting time calculating means 59 (step S29). A waiting time "$T_1$" of a first rescuable floor is given by the below-mentioned formula (1):

$$T_1=T_{oc}+T_{lgr}+T_{to} \tag{1}$$

In this formula (1), symbol "$T_{oc}$" indicates a door closing operation time on the evacuation floor; symbol "$T_{lgr}$" indicates a moving time of a car from the evacuation floor to the first rescuable floor; and symbol "$T_{to}$" indicates a door opening operation time on the rescuable floor.

Also, a waiting time "$T_n$" (symbol "n" is an integer equal to or larger than 2) of an n-th rescue target floor is given by the below-mentioned formula (2):

$$T_n=T_{n-1}+T_{tt}+T_{tc}+T_{nbr}+T_{oo}+T_{ot}+T_{oc}+T_{ngr}+T_{to} \tag{2}$$

In this formula (2), symbol "$T_{n-1}$" indicates a waiting time of an (n−1)-th rescuable floor; symbol "$T_{tt}$" indicates a door opening waiting time on the rescuable floor; symbol "$T_{tc}$" indicates a door closing operation time on the rescuable floor; symbol "$T_{nbr}$" indicates a moving time of a car from an n-th rescuable floor to the evacuation floor; symbol "$T_{oo}$" indicates a door opening waiting time on the evacuation floor; symbol "$T_{ot}$" indicates a door opening waiting time on the evacuation floor; symbol "$T_{ngr}$" indicates a moving time of a car from the evacuation floor to the n-th rescuable floor.

In the case of the train type operation mode, a total rescue count with respect to each of the rescuable floors is calculated by the rescue time calculating means 57 based upon a total number of remaining persons on each of the rescuable floors (step S30) A total rescue time "$N_n$" for an n-th rescuable floor (symbol "n" is equal to or larger than 1) is given by the below-mentioned formula (3):

$$N_n=R_n/P \tag{3}$$

In this formula (3), symbol "$R_n$" indicates a total number of remaining persons on the n-th rescuable floor, and symbol "P" indicates a value obtained by multiplying a total amount of capacities of the respective cars 7 by 1.1. Also, when a division remainder is produced, numerals equal to or smaller than a decimal point are rounded off to obtain "$N_n$".

After that, the waiting time calculating means 59 calculates a waiting time on each of the rescuable floors (step S31). In a case where a total rescue count for the first rescuable floor is equal to 1, a waiting time "$T_1$" on the first rescuable floor is given by the above-mentioned formula (1). Also, in the case where all of rescue counts with respect to the first rescuable floor to the n-th rescuable floor (symbol "n" is an integer equal to or larger than 2) are equal to 1, a waiting time "$T_n$" on the n-th rescuable floor is given by the above-mentioned formula (2).

Also, in a case where a total rescue count for the first rescuable floor is equal to "$N_1$" (symbol "$N_1$" is an integer equal to or larger than 2), a waiting time "$T_1$" on the first rescuable floor is given by the below-mentioned formula (4).

$$T_1=N_1\times(T_{lgr}+T_{to}+T_{tt}+T_{tc}+T_{lbr}+T_{oo}+T_{ot}+T_{oc}) \tag{4}$$

Further, in a case where a total rescue count for the n-th rescuable floor (symbol "n" is an integer equal to or larger than 2) is equal to "$N_n$" (symbol "$N_n$" is an integer equal to or larger than 2), a waiting time "$T_n$" on the n-th rescuable floor is given by the below-mentioned formula (5).

$$T_n=N_{n-1}+N_n\times(T_{lgr}+T_{to}+T_{tt}+T_{tc}+T_{lbr}+T_{oo}+T_{ot}+T_{oc}) \tag{5}$$

After that, the judging means 60 judges which of the rescue target floor and the staircase evacuation target floor is to be assigned to each of the rescuable floor, by comparing the waiting time "$T_n$" with the evacuation operation time "$T_p$", which are calculated by the waiting time calculating means 59 (step S32). In other words, when a waiting time is equal to or shorter than the evacuation operation time "$T_p$", each of the rescuable floors is selected to be the rescue target floor, whereas when a waiting time is longer than the evacuation operation time "$T_p$", each of the rescuable floors is selected to be the staircase evacuation target floor. For instance, in a case where a waiting time "$T_3$" on a third rescuable floor is 16 minutes; a waiting time "$T_4$" on a fourth rescuable floor is 22 minutes; and an evacuation operation time "$T_p$" is 20 minutes, the judging means 60 judges that the first to third rescuable floors are selected to be the rescue target floors, and such a floor whose priority is equal to or lower than that of the fourth rescuable floor is selected to be the stair case evacuation target floor. Also, when all of the rescuable floors are selected to be the staircase evacuation target floors, the decision of the evacuation operation schedule is stopped.

It should also be noted that the processing unit 54 judges whether or not a rescue with respect to each of the rescue target floors is completed based upon the information from the elevator controller 39 in connection with a time elapse of the evacuation operation of the elevator 4 (step S33). That is to say, when a total rescue count for the rescue target floor which is calculated by the rescue count calculating means 57 is equal to a total number of times that the cars 7 are landed from the rescue target floors to the evacuation floors, the processing unit 54 judges that the rescue is completed, whereas when a total rescue count for the rescue target floor which is calculated by the rescue count calculating means 57 is not equal to a total number of the times that the cars 7 are landed from the rescue target floors to the evacuation floors, the processing unit 54 judges that the rescue is not completed. Also, the processing unit 54 continuously updates a total number of remaining persons, a total rescue count, and a waiting time based upon the information from the elevator controller 39 in connection with a time elapse of the evacuation operation of the elevator 4.

Figure 10:
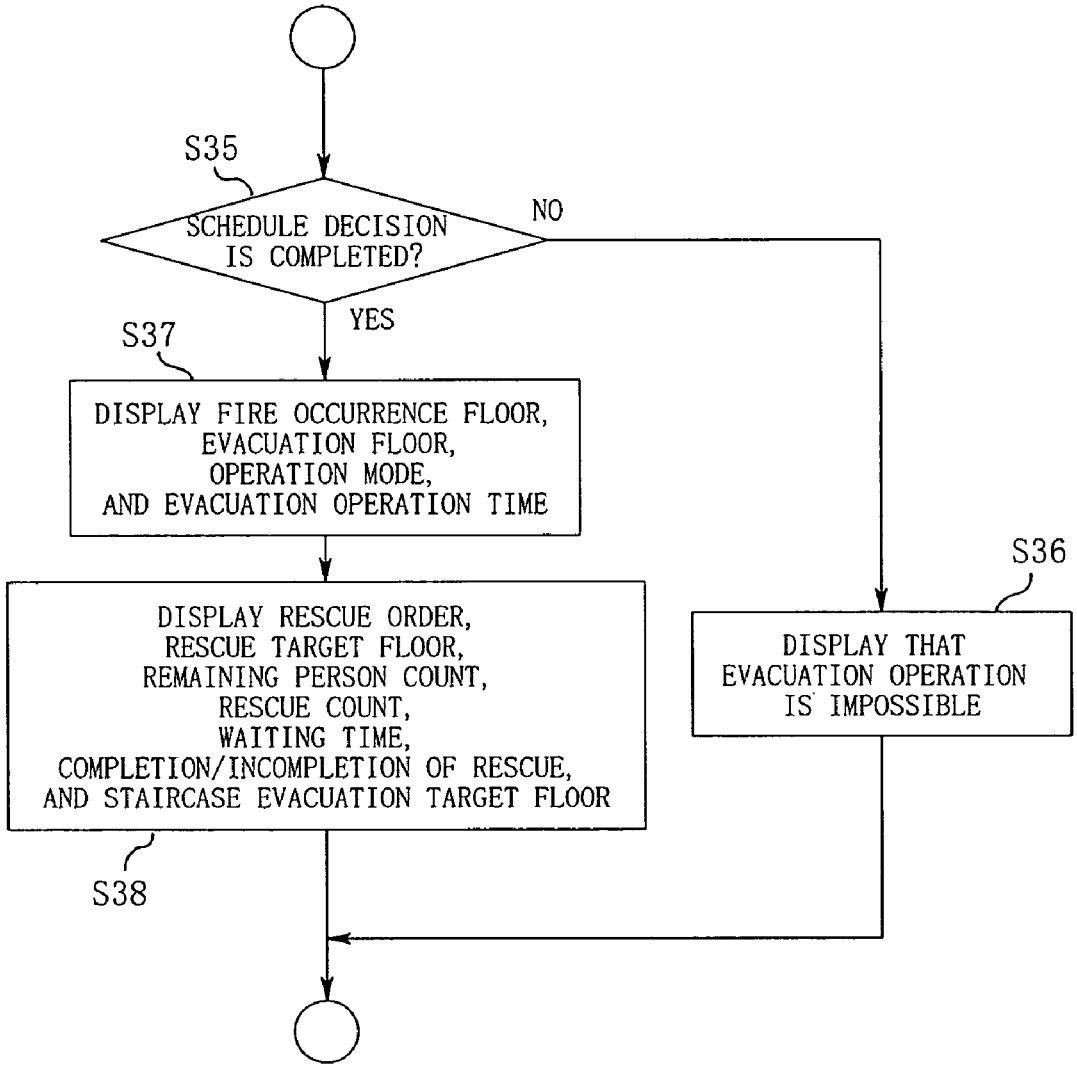
FIG. 10 A flow chart explaining a display operation of a display unit as to a fire-evacuation operation schedule which is decided by the processing unit of FIG. 4.

Next, a description is made of a method for displaying the evacuation operation schedule. FIG. 10 is a flowchart explaining a display operation by the display unit 55 as to the evacuation operation schedule decided by the processing unit 54 of FIG. 4. As indicated in the drawing, the processing unit 54 first judges whether or not a decision of the evacuation operation schedule is completed (step S35). When the decision of the evacuation schedule is not yet completed, the processing unit 54 displays such a message that the evacuation operation cannot be carried out on the display unit 55 (step S36).

When the decision of the evacuation schedule is completed, the processing unit 54 displays on the display unit 55, a fire occurrence floor, an evacuation floor, an operation mode, and an evacuation operation time, respectively (step S37). After that, the processing unit 54 displays on the display unit 55, a rescue order, a rescue target floor, a total number of remaining persons, a total rescue count, a waiting time, completion/incompletion of a rescue, and a staircase evacuation target floor, respectively (step S38).

It should be noted that a display on the in-car display apparatus 36 of the evacuation operation schedule is carried out by a similar manner operation.

Figure 11:
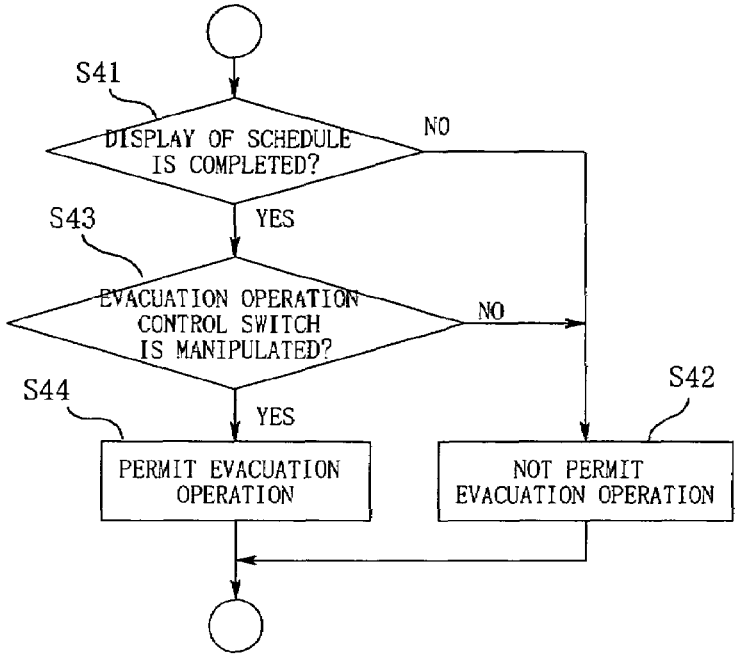
FIG. 11 A flow chart explaining a process operation of the processing unit shown in FIG. 4 when a judgement is made as to whether or not an evacuation operation is permitted during elevator control operation.

Next, an explanation is made of a judging method for judging whether or not an evacuation operation of the elevator 4 is permitted. FIG. 11 is a flow chart explaining a process operation of the processing unit 54 shown in FIG. 4 when the processing unit 54 judges whether or not an evacuation operation during control operation is permitted. As shown in the drawing, the processing unit 54 first judges whether or not the evacuation operation schedule is displayed on the display unit 55 (step S41). When the evacuation operation schedule is not displayed on the display unit 55, the processing unit 54 judges that the evacuation operation of the elevator 4 is not permitted (step S42).

When the display is performed on the display unit 55, the processing unit 54 judges whether the evacuation operation control switch 52 is manipulated (step S43). When the evacuation operation control switch 52 is not manipulated, the processing unit 54 judges that the evacuation operation of the elevator 4 is not permitted (step S42).

When the evacuation operation control switch 52 is manipulated, the evacuation operation of the elevator 4 is permitted (step S44), and the information of the evacuation operation schedule is transferred from the elevator managing board 47 to the elevator controller 39.

Figure 12:
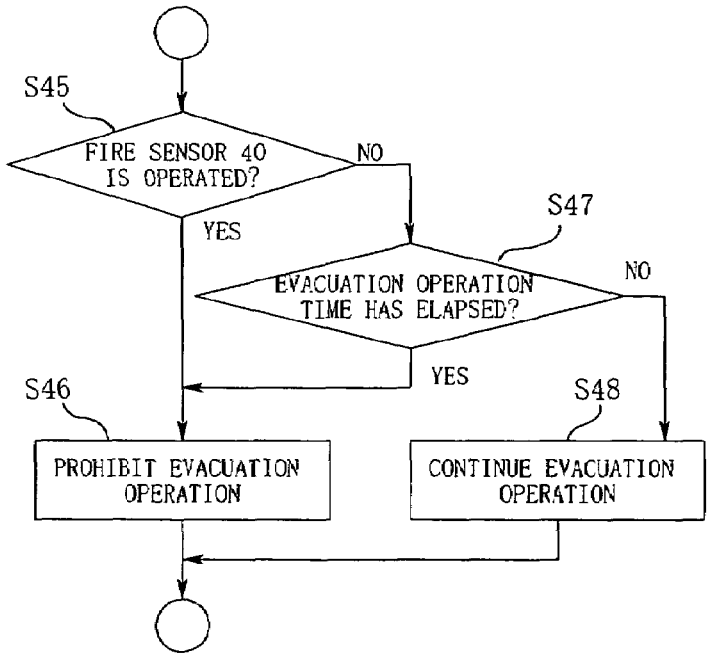
FIG. 12 A flow chart explaining a process operation of the processing unit shown in FIG. 4 in the case where a judgement is made as to whether or not an operation is continued during evacuation operation.

Next, a description is made of a judging method for judging whether or not a continuation of an evacuation operation of the elevator 4 is permitted. FIG. 12 is a flow chart explaining a process operation executed by the processing unit 54 of FIG. 4 when the processing unit 54 judges whether or not the operation continuation during the evacuation operation is permitted. As indicated in the drawing, the processing unit 54 first judges whether or not the fire sensor 40 within the elevator detects a fire based upon the information from the disaster prevention managing board 46 (step S45). In a case where the fire detecting operation is carried out, the permission of the evacuation operation of the elevator 4 is stopped. As a result, the continuation of the evacuation operation of the elevator 4 is prohibited (step S46).

In a case where the fire detecting operation is not carried out, the processing unit 54 judges whether or not an evacuation operation time has elapsed (step S47). In a case where the evacuation operation time has elapsed, the processing unit 54 stops permission of the evacuation operation of the elevator 4, and prohibits continuation the evacuation operation (step S46). In a case where the operation time is within the evacuation operation time, the processing unit 54 maintains to permit the evacuation operation of the elevator 4, and continues the evacuation operation (step S48).

Figure 13:
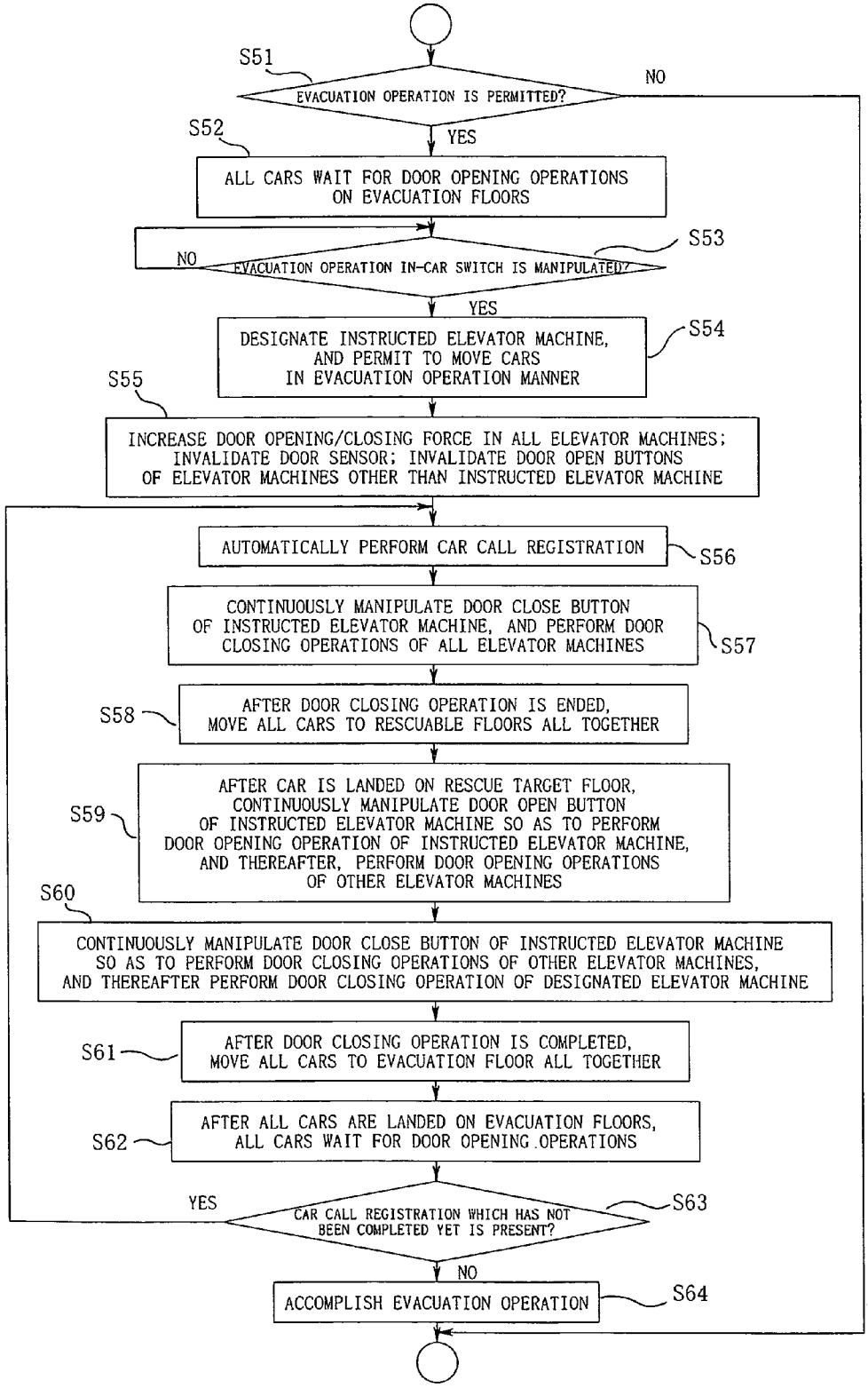
FIG. 13 A flow chart explaining the evacuation operation of the elevator 4 shown in FIG. 4 in a train type operation mode.

Next, a description is made of evacuation operations of the elevator 4 in the train type operation mode. FIG. 13 is a flow chart explaining the evacuation operation of the elevator 4 in the train type operation mode. As indicated in the drawing, the elevator controller 39 judges whether or not the evacuation operation by the elevator managing board 47 is permitted (step S51). In a case where the permission of the evacuation operation is stopped, the normal control operation of the elevator 4 is performed. As a result, all of the cars 7 are forcibly moved to the evacuation floor, and the stopping operations of the respective cars 7 at the evacuation floors are continued.

In a case where the evacuation operation is permitted, in all of the elevator machines 17*a* to 17*d*, the door opening operations are carried out for the elevator entrances of the cars 7 which are already waiting on the evacuation floors by way of the normal control operation, and the respective cars 7 wait on the evacuation floors while maintaining the door open status of the respective elevator entrances (step S52).

After that, the elevator controller 39 judges whether or not an evacuation operation in-car switch 35 is manipulated in any one of the elevator machines 17*a* to 17*d* (step S53). In the case where the evacuation operation in-car switch 35 is not manipulated, the elevator controller 39 repeatedly judges whether or not the evacuation operation in-car switch 35 is manipulated.

In a case where the evacuation operation in-car switch 35 is manipulated in any one of the elevator machines 17*a* to 17*d*, the elevator machine in which the evacuation operation in-car switch 35 is manipulated is defined as an instructed elevator machine by the elevator controller 39. As a result, the respective cars 7 can be moved by the evacuation operation (step S54).

In the evacuation operation of the elevator 4, opening/closing force of the elevator doors in all of the elevator machines 17*a* to 17*d* are set to be stronger than the normal opening/closing force, and operations of door sensors are invalidated. Also, operations of the door open buttons of the elevator machines except for the instructed elevator machine are invalidated (step S55).

After that, the elevator controller 39 automatically performs a car call registration based upon information of the evacuation operation schedule (step S56).

After that, when the manipulation of the door closing button 34 in the instructed machine is continuously performed (the button is pressed and held), the door closing operations of the elevator entrances in all of the elevator machines 17*a* to 17*d* are carried out (step S57). After that, when the door closing operations are completed, the respective cars 7 are moved to the automatically registered rescue target floors all together (step S58).

After the respective cars 7 have been landed on the rescue target floors, in a case where a manipulation of the door open button 33 of the instructed elevator machine is continuously carried out (the button is pressed and held), only a door opening operation of the elevator entrance of the instructed elevator machine is carried out. After this door opening operation is accomplished, door opening operations of other elevator machines than the instructed elevator machine are carried out (step S59). After that, the respective cars 7 wait on the rescue target floors while maintaining the door open status of the elevator entrances.

After that, when the manipulation of the door closing button 34 of the instructed machine is continuously performed (the button is pressed and held), the door closing operations of the other elevator machines are first carried out. After the door closing operations are completed, a door closing operation of the instructed elevator machine is carried out (step S60). After that, when the door closing operations of the elevator machines 17*a* to 17*d* are completed, the respective cars 7 are moved to the evacuation floors all together (step S61). After the respective cars 7 have been landed on the evacuation floors, door opening operations of all of the elevator entrances are carried out, and the respective cars 7 wait on the evacuation floors while maintaining the door open status of the elevator entrances (step S62).

After that, the elevator controller 39 judges whether or not the car call registration is required based upon the information of the evacuation operation schedule (step S63). In a case where at least one car call registering operation has not yet been ended among the car call registering operations based upon the information of the evacuation operation schedule, a car call registering operation which has not yet ended and owns the highest priority is automatically performed (step S56). After that, the evacuation operation is carried out again. When all of the car call registering operations are accomplished, the evacuation operation of the elevator 4 is accomplished (step S64).

Figure 14:
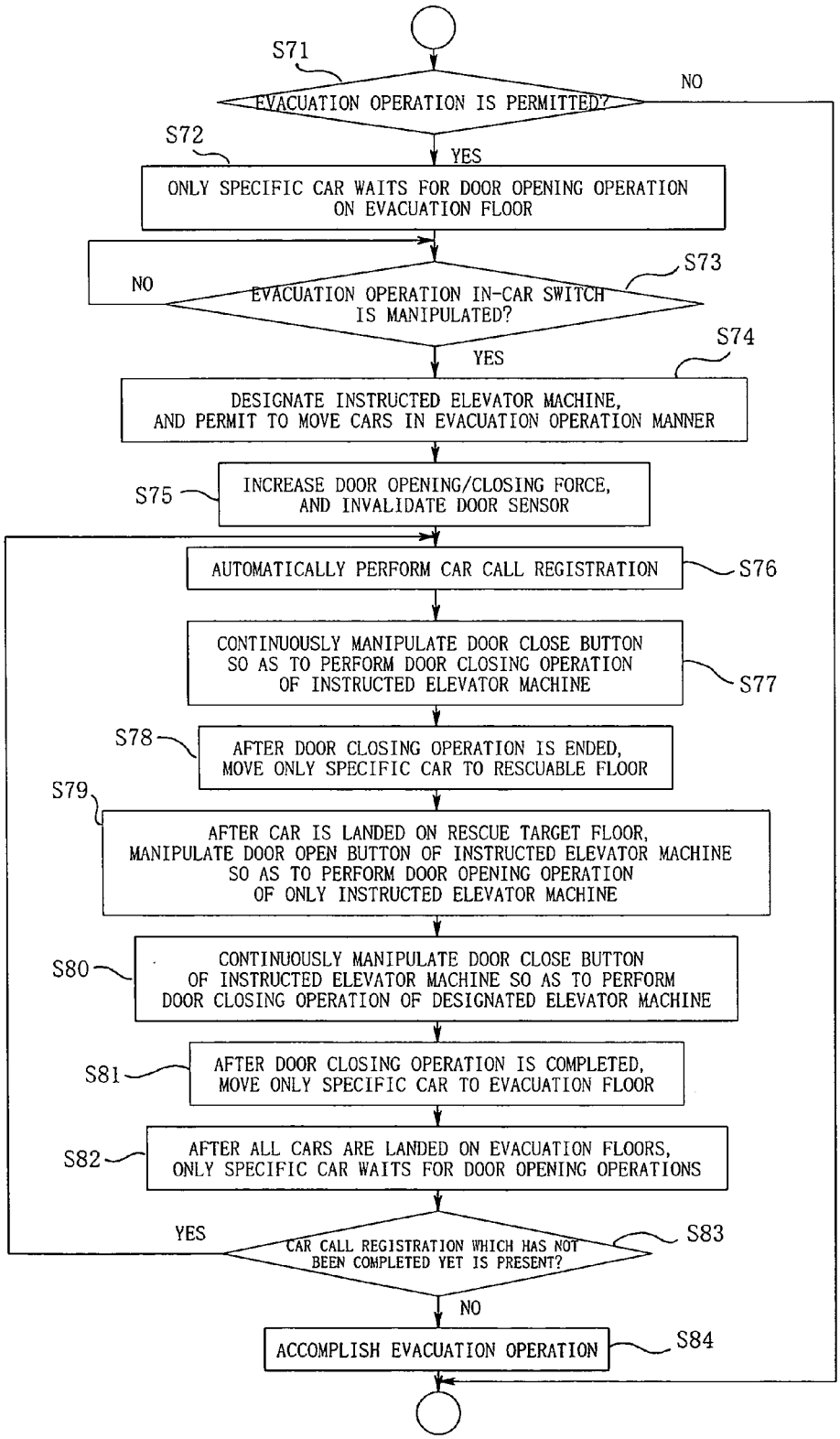
FIG. 14 A flow chart explaining the evacuation operation of the elevator 4 shown in FIG. 4 in a taxi type operation mode.

Next, a description is made of evacuation operations of the elevator 4 in the taxi type operation mode. FIG. 14 is a flow chart explaining the evacuation operation of the elevator 4 in the taxi type operation mode. As indicated in the drawing, the elevator controller 39 judges whether or not the decision of the evacuation operation schedule by the elevator managing board 47 is completed, and the manipulation of the evacuation operation permission by the evacuation operation control switch 52 is completed (step S71). In a case where at least any one operation as to the decision of the evacuation operation schedule and the manipulation of the evacuation operation permission is not yet completed, the normal control operation of the elevator 4 is performed. As a result, all of the cars 7 are forcibly moved to the evacuation floors, and the stopping operations of the respective cars 7 at the evacuation floors are continued.

In a case where any operations as to the decision of the evacuation operation schedule and the manipulation of the evacuation operation permission are completed, only in a limited elevator machine (specific elevator machine) which has been previously set, the door opening operation is performed for the elevator entrance of the car 7 which is already waiting on the evacuation floor due to the normal control operation, and only the car 7 of this elevator machine waits on the evacuation floor while maintaining the door open status (step S72). In this example, the first elevator machine 17*a* is defined as the specific elevator machine.

After that, the elevator controller 39 judges whether or not the evacuation operation in-car switch 35 is manipulated in the first elevator machine 17*a* (step S73). In a case where the evacuation operation in-car switch 35 is not manipulated, the elevator controller 39 repeatedly judges whether or not the evacuation operation in-car switch 35 is manipulated.

In a case where the evacuation operation in-car switch 35 is manipulated, the first elevator machine 17*a* is defined as the instructed elevator machine, and in the first elevator machine 17*a*, the cars 7 can be moved by the evacuation operation (step S74).

In the evacuation operation of the elevator 4, opening/closing force of the elevator door in the first elevator machine 17*a* is set to be stronger than the normal opening/closing force, and an operation of door sensor is invalidated (step S75).

After that, the elevator controller 39 automatically performs the car call registering operation based upon information of the evacuation operation schedule (step S76).

After that, when the manipulation of the door closing button 34 in the first elevator machine 17*a* is continuously performed (the button is pressed and held, the door closing operation of the elevator entrance is carried out (step S77). After that, when the door closing operation is completed, only the car 7 of the first elevator machine 17*a* is moved to the automatically registered rescue target floor (step S78).

After the cars 7 have been landed on the rescue target floors, in a case where a manipulation of the door open button 33 of the first elevator machine 17*a* serving as the instructed elevator machine is continuously carried out (the button is pressed and held), a door opening operation of the elevator entrance of the first elevator machine 17*a* is carried out, and the car 7 waits on the rescue target floors while maintaining the door open status of the elevator entrance (step S79).

After that, in the first elevator machine 17*a*, the door close button 34 is manipulated and this manipulation is continued (the button is pressed and held), the door closing operation of the elevator entrance is carried out (step S80). Subsequently, when the door closing operation is completed, the car 7 is moved to the evacuation floor (step S81). After that, when the car 7 is landed on the evacuation floor, the door opening operation of the elevator entrance is carried out, and the car 7 waits on the evacuation floor while maintaining the door open status of the elevator entrance (step S82).

After that, the elevator controller 39 judges whether or not a car call registration is required based upon the information of the evacuation operation schedule (step S83). In a case where at least one car call registration has not yet been ended among the car call registering operations based upon the information of the evacuation operation schedule, the elevator controller 39 automatically performs a car call registering operation which has not yet ended and owns the highest priority (step S76). After that, the evacuation operation is carried out again. When all of the car call registering operations are completed, the evacuation operation of the elevator 4 is ended (step S84).

Next, a description is made of a procedure in a case where a fire breaks out in the building 1. A fire prevention supervisor (not shown) of the disaster prevention center 45 continuously monitors as to whether or not the fire detecting operation is performed by each of the fire sensors 40 and 41 by using the disaster prevention managing board 46. For instance, in a case where a fire happens to occur on the 25th floor of the building 1, and the fire prevention supervisor finds out the fire detecting operation of the in-building fire sensor 41, the fire prevention supervisor broadcasts a message indicating the operation of the elevator 4 is switched to the control operation by using the broadcasting facility 48 to the respective elevator halls 15, and thereafter, manipulates the control switch 51. As a consequence, the normal control operation is carried out by the elevator managing board 47 for the elevators 2 to 4, and the respective cars 5 to 7 are forcibly moved to the evacuation floors.

Also, in the disaster prevention managing board 46, an evacuation operation time is calculated based upon the information from the respective fire sensors 40 and 41. As a result, the evacuation time is displayed on the display unit 55. When the evacuation operation time is zero, the evacuation operation schedule is not decided, and the fire prevention supervisor broadcasts an evacuation instruction by using the emergency staircase 10 by the broadcasting facility 48 to the respective elevator halls 15.

When the evacuation operation time is present, the fire prevention supervisor communicates with fire prevention floor supervisors 65 (FIG. 4) arranged on the respective floors by using portable telephones or the like to acquire information as to a total number of remaining persons on each of the floors. After that, the fire prevention supervisor inputs the total number of the remaining persons in the respective floors in the elevator managing board 47. As a result, the evacuation operation schedule is displayed on the display unit 55 and the in-car display apparatus 36.

After that, the fire prevention supervisor broadcasts an evacuation operation announcement (evacuation guide sign) by the broadcasting facility 48 to the respective elevator halls 15. The evacuation operation announcement includes, for example, the following announcements: information as to whether or not a car is landed on each of the floors by the evacuation operation; waiting times on the respective rescue target floors; operating conditions of the evacuation operation; progress conditions of the fire; and an evacuation instruction on the staircase evacuation target floor by the emergency step 10. To be specific, the fire prevention supervisor confirms the evacuation operation schedule, and thereafter, broadcasts an announcement that the elevator 4 can be used for evacuation purposes, a predicted waiting time, and an attention during the evacuation operation, to the elevator hall 15 of the floor listed as the rescue target floor by using the broadcasting facility 48. Also, the fire prevention supervisor broadcasts announcements that the elevator 4 cannot be used for evacuation purposes, and the evacuation operation is performed by using the emergency step 10, to the elevator hall 15 of the floor listed as the staircase evacuation target floor by using the broadcasting facility 48. Also, the fire prevention supervisor broadcasts progress conditions of the fire based upon the fire detecting operation of the fire sensor to the respective elevator halls 15.

After that, the fire prevention supervisor manipulates the evacuation operation control switch 25. As a result, the elevators 2 to 4 are operated in the evacuation operation mode which is displayed on the display unit 55 and the in-car display apparatus 36. The evacuation operation is carried out by a driver 66 serving as a driving operator, or a guide 67 serving as a driving operator when there is a time to spare.

When the evacuation operation mode is set to the train type operation mode by the processing unit 54, the driving operator gets on any one of the cars 7 which wait on the evacuation floors, and manipulates the evacuation operation in-car switch 35 of the car 7 on which the driving operator gets. Due to the manipulation of the evacuation operation in-car switch 35, an elevator machine as to the car 7 on which the driving operator gets is defined as the instructed elevator machine. After that, the driver 66 within the car 7 presses and holds the door close button 34. As a result, the door closing operation of the elevator entrance is carried out, and a car call registration to the rescue target floor is automatically performed.

After the door closing operation is completed, all of the cars 7 are moved to the rescue target floors and the respective cars 7 are landed on the rescue target floors. After that, if the driver 66 presses and holds the door open button 33, a door opening operation of the elevator entrance in the instructed elevator machine is carried out. After this door opening operation is completed, door opening operations of elevator machines other than the instructed elevator machine are carried out.

Subsequently, either the driver 66 or the guide 67 guides the remaining persons on the rescue target floors into the respective cars 7. After the completion of the guiding operation of the remaining persons to the cars 7 is confirmed, the driver 66 within the car 7 presses and holds the door close button 34. As a result, the door closing operations of the elevator machines other than the instructed elevator machine are carried out, and after the door closing operations are completed, a door closing operation of the instructed elevator machine is carried out. When the door closing operations for all of the elevator machines are completed, all of the cars 7 are moved to the evacuation floors.

When the respective cars 7 are landed on the evacuation floors, the door opening operations of all of the elevator machines are automatically carried out, so that the remaining persons within the respective cars 7 are guided to the elevator hall of the evacuation floor.

After that, the driving operator repeatedly performs the evacuation operation until the evacuation operation time has elapsed in accordance with the above-mentioned procedure, and guides the remaining persons on the respective rescue target floor to the evacuation floor.

When the evacuation operation mode is set to the taxi type operation mode by the processing unit 54, a door opening operation of only an elevator entrance in a previously set elevator machine (specified elevator machine) is carried out. After that, the driving operator gets on the car 7, and manipulates the evacuation operation in-car switch 35. As a result, the specified elevator machine on which the driving operator gets is defined as the instructed elevator machine. After that, the driver 66 within the car 7 presses and holds the door close button 34. As a result, the door closing operation of the elevator entrance is carried out, and a car call registration to the rescue target floor is automatically performed.

After the door closing operation is accomplished, only the car 7 of the specified elevator machine is moved to the rescue target floor. After the car 7 is landed on the rescue target floor, if the driver 66 presses and holds the door open button 33, a door opening operation of the elevator entrance at which the car 7 is landed is carried out. After that, the guide 67 guides the remaining persons on the rescue target floor into the car 7. After the driver 66 confirms that the guiding operation of the remaining persons to the car 7 is completed, the driver 66 within the car 7 presses and holds the door close button 34. As a result, the door closing operation of the elevator entrance is carried out, and after the door closing operation is completed, the car 7 on which the remaining persons get is moved to the evacuation floor.

When the car 7 is landed on the evacuation floor, the door opening operation of the elevator entrance is automatically carried out, so that the remaining persons within the car 7 are guided to the elevator hall of the evacuation floor.

After that, the driving operator repeatedly performs the evacuation operation until the evacuation operation time elapses in accordance with the above-mentioned procedure, and guides the remaining persons on the respective rescue target floor to the evacuation floor.

Figure 15:
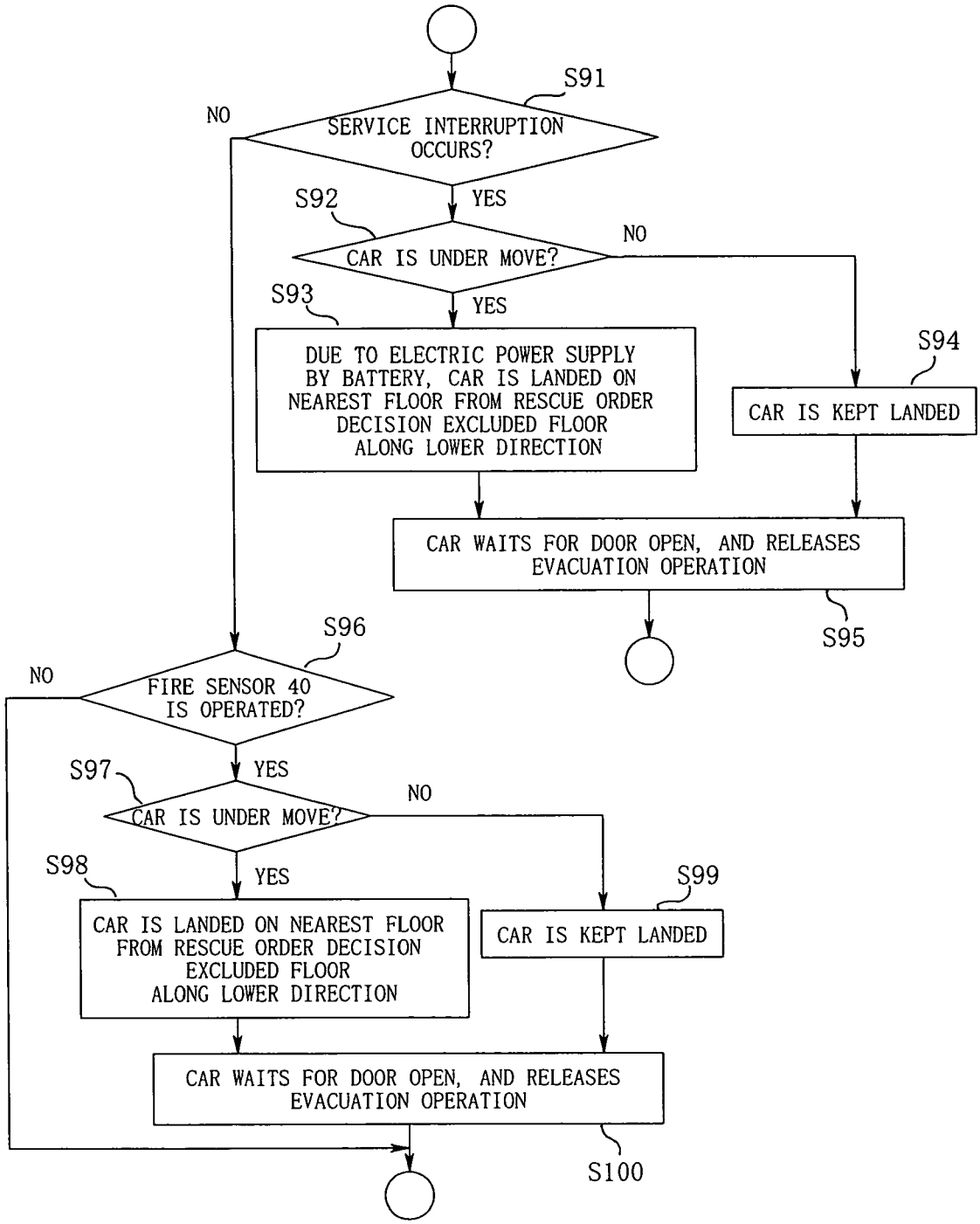
FIG. 15 A flow chart explaining the evacuation operation of the elevator 4 shown in FIG. 4 when an abnormal condition happens to occur.

Next, a description is made of an evacuation operation method in a case where an abnormal event occurs during evacuation operation of the elevator 4. FIG. 15 is a flow chart explaining evacuation operations of the elevator 4 of FIG. 4 in response to an occurrence of an abnormal event. As indicated in the drawing, the elevator controller 39 first judges whether or not a supply of electric power to the elevator 4 is stopped due to an occurrence of a service interruption (step S91) In a case where the service interruption occurs, the elevator controller 39 judges whether or not the car 7 is being moved (step S92).

In a case where the car 7 is being moved when the service interruption occurs, the car 7 is moved at a low speed by being supplied by a battery, and then, is landed on the nearest floor located lower than a rescue order decision excluded floor (step S93). In a case where the car 7 is landed on either the rescue target floor or the evacuation floor when the service interruption occurs, the car 7 is kept landed thereon without being moved (step S94). After that, a door opening operation of the elevator entrance is carried out, and the evacuation operation of the elevator 4 is forcibly released under door open status (step S95).

In a case where a service interruption does not occur, and the supply of the electric power to the elevator 4 is maintained, the elevator controller 39 judges whether or not the fire sensor 40 within the elevator has performed a fire detecting operation based upon the information from the elevator managing board 47 (step S96). In a case where the fire sensor 40 has performed the fine detecting operation, the elevator controller 39 judges whether or not the car 7 is being moved (step S97).

In a case where the car 7 is being moved while the fire sensor 40 within the elevator is operated, the car 7 is moved to the nearest floor located lower than the rescue order decision excluded floor, and then is landed thereon (step S98) In a case where the car 7 has been landed on either the rescue target floor or the evacuation floor while the fire sensor 40 within the elevator is operated, the car 7 is kept landed thereon without being moved (step S99). After that, a door opening operation of the elevator entrance is carried out, and the evacuation operation of the elevator 4 is forcibly released under door open status (step S100).

In such the fire emergency control operation system of elevators, the evacuation operation time is calculated based upon the positional relationship between the elevator 4 and the fire sensors 40 and 41 which perform the fire detecting operations; the evacuation operation schedule is decided as to each of the floors, for conveying the remaining persons to the evacuation floor by way of the evacuation operation within the evacuation operation time based upon the evacuation operation time, the fire occurrence floor, and the total remaining persons on the respective floors; and then the evacuation operation schedule is displayed on the display unit 55. As a result, even after the fire sensor has performed the fire detecting operation, the operating system can judge whether or not the operation of the elevator is permitted, and also, the remaining persons can be conveyed to the evacuation floor within the evacuation operation time during which the elevator can be operated. Also, since the operation of the elevator is controlled based upon the information of the evacuation operation schedule, the remaining persons within the building 1 can be rescued with efficiency. Further, since the content of the evacuation operation schedule is displayed, the rescue scheme by the evacuation operation can be notified also to the remaining persons within the building 1, so that it is possible to avoid a panic caused by the remaining persons gathering on a specific floor, or at the emergency staircase 10 and the like.

Also, the evacuation operation of the elevator 4 can be switched between the train type operation mode for moving the cars 7 in all of the elevator machines 17*a* to 17*d* all together, and the taxi type operation mode for moving only the car 7 in the first elevator machine 17*a* corresponding to a portion of the elevator machines 17*a* to 17*d*. The processing unit 54 is provided with the operation mode selecting means 56 for selecting one of the train type operation mode and the taxi type operation mode based on a total number of remaining persons on each of the floors. As a result, the evacuation operation can be carried out in response to a total number of remaining persons on each of the floors.

Also, the processing unit 54 is provided with: the rescue count calculating means 57 for calculating the rescue count for each of the floors; the rescue order deciding means 58 for deciding the priority for each of the floors; the waiting time calculating means 59 for calculating the waiting time in each of the floors; and the judging means 60 for judging both the rescue target floor from which the remaining person is rescued, and the rescue prohibited floor in which the rescue of the remaining person is prohibited. Since the evacuation operation schedule is decided in a manner that the schedule contains the total number of the remaining persons, the rescue count, and the waiting time for the rescue target floor, both the rescue target floor and the rescue prohibited floor (staircase evacuation target floor) can be recognized before the evacuation operation is carried out and while the evacuation operation is performed. As a result, it is possible to avoid such the panic caused by the remaining persons gathering on a specific floor, or at the emergency staircase 10 and the like.

Also, the evacuation operation in-car switch 35 is provided in each of the cars 7 for specifying any one of the plural elevator machines as the instructed elevator machine, and in the train type operation mode, the elevator controller 39 controls the operations of all of the elevator machines based upon the manipulation of the operation button within the car 7 in the instructed elevator machine, whereas in the taxi type operation mode, the elevator controller 39 controls only the operation of a limited elevator machine (specific elevator machine) based upon the manipulation of the operation button within the car 7 in the instructed elevator machine. As a result, it is possible to prevent the evacuation operation from being mistakenly carried out by manipulation of the operation button by the remaining person unless the evacuation operation in-car switch 35 is manipulated. Moreover, the evacuation operation can be carried out only by manipulating the operation button in the instructed elevator machine, so that a total number of the driving operators can be reduced.

Also, due to manipulation of the door close button in the instructed elevator machine, the door closing operations of the elevator entrances of other elevator machines other than the instructed elevator machine is performed. After the door closing operations are completed, the door closing operation of the elevator entrance of the instructed elevator machine is carried out. As a result, when the door closing operations of the elevator entrances of other elevator machines are completed, the driving operator can check whether or not there are remaining persons who are delayed to get on, for example, the cars 7 of other elevator machines, and thus, can more firmly rescue the remaining persons on the rescue target floors to the evacuation floors.

Also, in a case where the car 7 is landed on the rescue target floor while the evacuation operation is carried out, the door opening operations of the elevator entrances are carried out only when the door open button 33 provided in the car 7 is manipulated. Therefore, after the evacuation guide by the driving operator has been prepared, the door opening operation can be carried out, so that the remaining persons of the rescue target floor can be more firmly guided.

Also, the in-car display apparatus 36 for displaying the content of the evacuation operation schedule is provided in each of the cars 7. As a result, the content of the evacuation operation schedule can be checked in the respective cars 7, and thus, the remaining persons can be more effectively guided to the evacuation floor by the driving operator.

Also, only when the application of the evacuation operation is selected by manipulating the evacuation operation control switch 52, the elevator controller 39 controls the operations of the elevators based upon the information of the evacuation operation schedule. As a result, the elevator controller can judge whether or not the evacuation operation is applied according to conditions within the building 1.

Also, the processing unit 54 obtains a total number of the remaining persons which have been conveyed to the evacuation floor based upon the information from the elevator controller 39, and then, updates the evacuation operation schedule based upon the calculated total number of the remaining persons. As a result, even after the evacuation operation has been commenced, the processing unit 54 can grasp a total number of the remaining persons on each of the floors.

Also, since the elevator hall speaker 42 for notifying the content of the evacuation operation schedule is provided on each of the floors, the content of the evacuation operation schedule can be notified to the remaining persons in the respective floors. As a result, it is possible to avoid the panic caused by the remaining persons gathering on a specific floor, or at the emergency staircase 10 and the like.

Also, in such the fire emergency control operation method of the elevators, the content of the evacuation operation schedule is displayed on the display unit 55, and the content of the evacuation operation schedule is notified to the respective floors. After that, the evacuation operation of the elevator is carried out based upon the information of the evacuation operation schedule displayed on the display unit 55. As a result, before the evacuation operation in a case where the fire occurred in the building 1 is carried out, the content of the evacuation operation schedule can be notified to the remaining persons, so that it is possible to avoid that the remaining persons are brought into the panic. As a result, the remaining persons within the building 1 can be effectively rescued.

Also, the evacuation operation schedule is decided as follows. The fire occurrence floor is defined as the rescue order decision excluded floor, and in a case where a floor is present upper than the rescue order decision excluded floor, the evacuation operation is sequentially carried out from a floor immediately above the fire adjacent to the rescue order decision excluded floor along the upper direction to the upper floors, whereas in a case where a floor is present only lower than the rescue order decision excluded floor, the evacuation operation is sequentially carried out from a floor immediately above the fire adjacent to the rescue order decision excluded floor along the lower direction to the lower floors. Therefore, an influence such as wind pressure caused by the fire can be reduced while the evacuation operation is performed. As a result, the remaining persons within the building 1 can be more effectively rescued.

Also, in the above-mentioned example, the total number of the remaining persons grasped by the fire prevention floor-supervisor is entered through the input unit 53 in the artificial operation. Alternatively, photographing apparatus for photographing the remaining persons in the respective floors may be installed in the elevator halls 15 of the respective floors, and then, a total number of the remaining persons which is obtained from images photographed by the respective photographing apparatus may be entered to the processing unit 54. In other words, the photographing apparatus may be employed as a remaining person count input means. In this case, the total numbers of the remaining persons in the respective floors may be automatically inputted to the processing unit 54. As a result, the artificial error caused by the fire prevention floor-supervisor can be avoided, and thus, the numbers of the remaining persons entered to the processing unit 54 can be more correctly defined.

Further, while a total number of present persons on each of the floors has been previously registered from the input unit 53 to the processing unit 54, and the registered number of the present persons is employed as a total number of the remaining persons on the respective floors, an evacuation operation schedule may be decided by the processing unit 54. As a result, for example, in a case of an office building which has a small number of visitors, the total number of the remaining persons on each of the floors may be more correctly grasped.

Further, both positions and total number of remaining persons may be grasped using a GPS (Global Positioning System) portable terminal and entered to the processing unit 54.

SECOND EMBODIMENT

Figure 16:
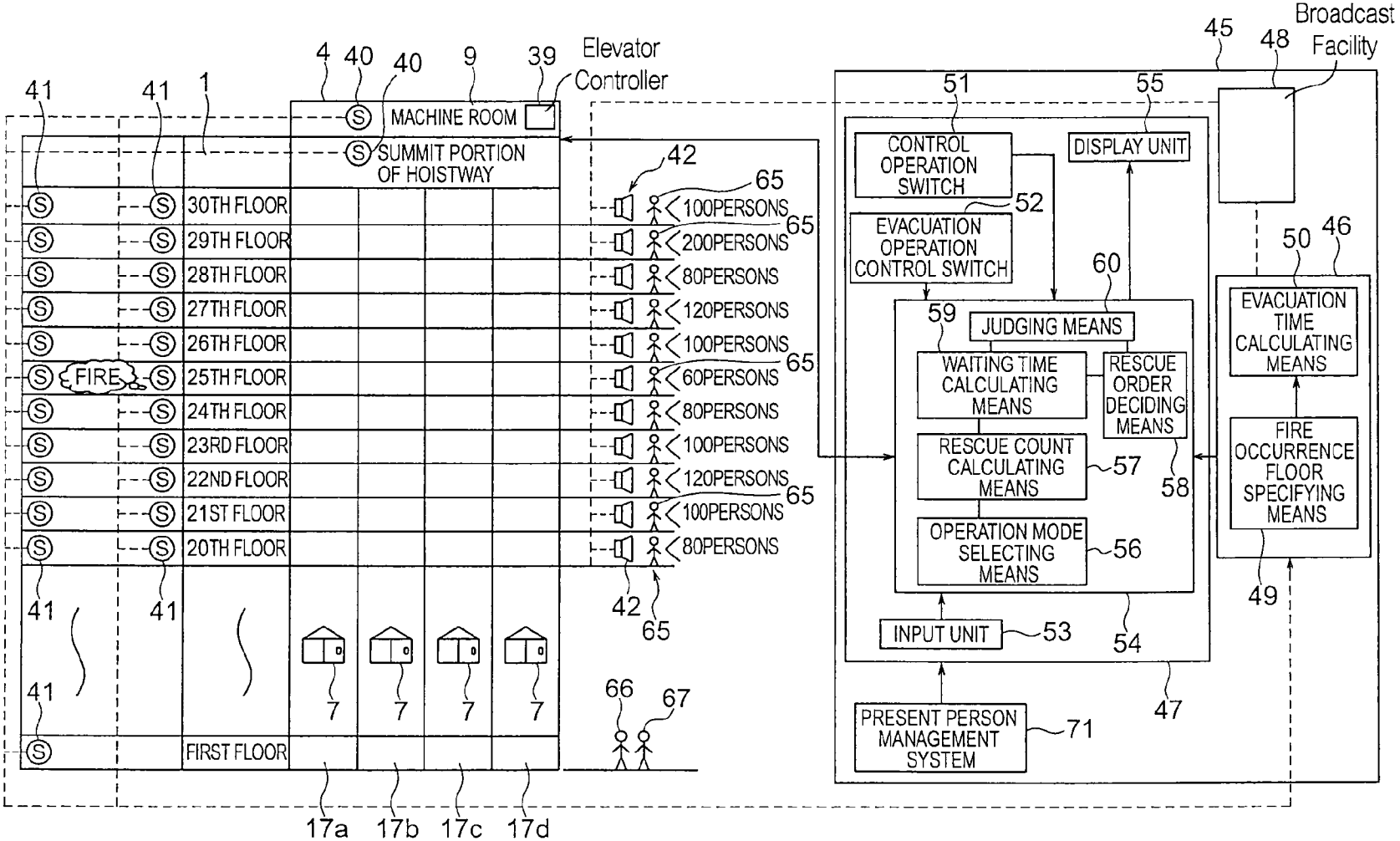
FIG. 16 A block diagram schematically showing a fine emergency operating system of an elevator according to a second embodiment of the present invention.

FIG. 16 is a block diagram for showing a fire emergency control operation system of an elevator according to a second embodiment of the present invention. In the drawing, a present person management system 71, serving as a remaining person input means which counts a total number of remaining persons in each of the floors, is provided in the building 1. The present person management system 71 includes a personal identification transmitting apparatus which is carried by a present person in the building 1, and a plurality of personal identification receiving apparatus installed in the elevator halls 15 of the respective floors.

In the personal identification transmitting apparatus, personal identification information, such as destination floors of present persons, and characteristic information (an able-bodied person, or a handicapped person), is previously registered. As the personal identification transmitting apparatus, for example, a key equipped with a non-contact tag, a card equipped with a non-contact tag, a portable telephone equipped with a non-contact tag, and the like may be used. It should be noted that in this example, the present persons of the building 1 carry the personal identification transmitting apparatus into which the personal identification information is previously registered. Also, in a case where visitors intend to enter the building 1, the personal identification information is registered to the personal identification transmitting apparatuses which are carried by the visitors when entering the building 1.

Each of the personal identification receiving apparatuses is designed to receive the personal identification information from the personal identification transmitting apparatus. The present person management system 71 calculates a total number of remaining persons on each of the floors based upon the personal identification information received by each of the personal identification receiving apparatus. The information of the total number of the remaining persons on the respective floors is inputted to the processing unit 54 from the present person management system 71 in the serial communication manner. Other arrangements and operations are similar to those of the first embodiment.

With employment of the above-mentioned arrangement and operations, the total numbers of the remaining persons on the respective floors can be automatically inputted to the processing unit 54 from the present person management system 71. Therefore, the artificial error caused by the fire prevention floor-supervisor can be avoided, and thus, the numbers of the remaining persons entered to the processing unit 54 can be more correctly defined.

It should also be noted that although only the fire occurrence floor is defined as the rescue order decision excluded floor in the above-mentioned respective embodiments, either both the fire occurrence floor and the floor immediately below the fire or both the fire occurrence floor and the floor immediately above the fire may be defined as the rescue order decision excluded floor. Alternatively, the fire occurrence floor, the floor immediately above the fire, and the floor immediately below the fire may be defined as the rescue order decision excluded floor. Also, since a fire spreading speed from the fire occurrence floor to the upper floors is faster than that to the lower floors, the fire occurrence floor, the floor immediately above the fire, and the floor adjoining the floor immediately above the fire along the upper direction may be defined as the rescue order decision excluded floor. Even in the case, an adverse influence such as wind pressure caused by the fire can be reduced while the evacuation operation is performed. As a result, the remaining persons within the building 1 can be more effectively rescued.

Also, in the above-mentioned respective embodiments, in a case where there are floors located above the rescue order decision excluded floor, the evacuation operation is sequentially carried out from the floor immediately above the fire to the upper floors. Alternatively, the evacuation operation may be sequentially carried out from the uppermost floor to the lower floors except for the rescue order decision excluded floor. Even in the case, an adverse influence such as wind pressure caused by the fire can be reduced while the evacuation operation is performed. As a result, the remaining persons within the building 1 can be more effectively rescued.

Also, in the case where there are floors located only below the rescue order decision excluded floor in the above-mentioned respective embodiments, the evacuation operation is sequentially carried out from the floor adjoining to the rescue order division excluded floor to the lower floors. Alternatively, the evacuation operation may be sequentially carried out from the lowermost floor to the upper floors except for the rescue order decision excluded floor. Even if such an alternative definition is employed, an adverse influence such as wind pressure caused by the fire while the evacuation operation is performed can be reduced. As a consequence, the remaining persons within the building 1 can be more effectively rescued.

Also, in the above-mentioned respective embodiments, the processing unit 54 is provided on the elevator management board 47. Alternatively, the processing unit 54 may be mounted on either the elevator controller 47 or the fire prevention management board 46. Even if such an alternative case is employed, the evacuation operation schedule can be decided, and the evacuation operation of the elevator can be carried out when the fire breaks out.

Also, in the above-mentioned respective embodiments, in the evacuation operation of the taxi type operation mode, only the cars 7 of one elevator machine are moved. Alternatively, the cars 7 of two or more sets of the elevator machines may be moved. Further, in the respective embodiments, the evacuation operation can be switched between the train type operation mode and the taxi type operation mode. Alternatively, only the evacuation operation of the train type operation mode may be alternatively carried out. Even when such an alternative operation mode is employed, the evacuation operation may be alternatively carried out in response to a total number of remaining persons in each of the floors.

Also, in each of the above embodiments, the evacuation operation schedule is displayed on both the display unit 55 of the elevator management board 47 and the in-car display apparatus 36 provided in each of the cars 7. Alternatively, while an elevator hall display apparatus may be provided with the elevator hall 15 of each of the floors as a display means, the evacuation operation schedule may be displayed on each of the elevator hall display apparatus. In this alternative case, the respective elevator hall display apparatus is electrically connected to the elevator management board 47, so that the content of the evacuation operation schedule outputted from the elevator controller 39 may be displayed thereon.

Also, the content of the evacuation operation schedule may be displayed on a display screen of a portable personal computer which is carried by a driving operator. In this alternative case, the information of the evacuation operation schedule is transferred from the elevator management board 47 to the portable personal computer by wireless communication.

Also, in each of the above embodiments, the evacuation operation control switch 52 is provided on the elevator management board 47, and the evacuation operation control switch 52 is manually operated in order to select whether or not the evacuation operation is applied. Alternatively, this selection as to whether or not the evacuation operation is applied may be automatically carried out by the processing unit 54. In this alternative case, when the decision of the evacuation schedule is completed and a rescue target floor is present in the content of the evacuation operation schedule, the processing unit 54 judges that the evacuation operation is applied.

Also, in the above-mentioned respective embodiment, the instructed elevator machine is specified by manipulating the evacuation operation in-car switch 35. Alternatively, the instructed elevator machine may be previously set to the elevator controller 39. With this alternative setting, the instructed elevator machine can be automatically specified when the evacuation operation is carried out, so the cumbersome operation by manipulating the evacuation operation in-car switch 35 can be omitted.

Also, in each of the above embodiments, when the evacuation operation is carried out, the car call registering operation to the rescue target floor is automatically carried out under control of the elevator controller 39 based upon the information as to the evacuation operation schedule. Alternatively, the car call registering operation may be carried out by manipulating the destination floor button 32 provided in the car 7. Even in this alternative case, the driving operator can perform the car call registering operation in accordance with the content of the evacuation operation schedule which is displayed on the in-car display apparatus 36 and the display screen of the portable personal computer.

Also, in the above-mentioned respective embodiments, when the evacuation operation is carried out, the opening/closing operations of the elevator entrances are carried out by manipulating both the door open button 33 and the door close button 34. Alternatively, the opening/closing operations of the elevator entrances may be automatically carried out under control of the elevator controller 39. In this alternative case, the operations of the elevator is controlled by the elevator controller 39 in such a manner that when the car is landed on each of the floors, the door opening operations of the elevator entrances may be automatically carried out, and the door closing operation is carried out after a predetermined time has passed since the door opening operation has been completed. As a result, the evacuation operation of the elevator may be alternatively carried out in a full automatic manner.

The invention claimed is:

1. A fire emergency control operation system for an elevator, in which when a fire sensor installed in a building having a plurality of floors, detects a fire, remaining persons within the building are conveyed to an evacuation floor through an evacuation operation of the elevator provided in the building, comprising:

evacuation time calculating means for acquiring a positional relationship between the elevator and the fire sensor which performs the fire detecting operation based upon information from the fire sensor to calculate an evacuation operation time based upon the obtained positional relationship;

fire occurrence floor specifying means for specifying a fire occurrence floor based upon the information from the fire sensor;

remaining person count input means for inputting a number of the remaining persons in correspondence with each of the floors;

schedule deciding means for deciding an evacuation operation schedule for the respective floors when the remaining persons are conveyed to the evacuation floor based upon the information from the evacuation time calculating means, the fire occurrence floor specifying means, and the remaining person count input means;

display means for displaying thereon a content of the evacuation operation schedule; and elevator control means for controlling the operation of the elevator based upon the information of the evacuation operation schedule.

2. The fire emergency control operation system for an elevator according to claim 1, wherein:

the elevator comprises a plurality of elevator machines including cars which can be moved within the building;

the evacuation operation can be switched between a train type operation mode by which the cars in all the elevator machines are moved together, and a taxi type operation mode by which only the cars in a part of the elevator machines; and the schedule deciding means comprises operation mode selecting means for selecting the train type operation mode and the taxi type operation mode based upon the number of the remaining persons in each of the floors.

3. The fire emergency control operation system for an elevator according to claim 2, wherein:

the schedule deciding means further comprises:

rescue count calculating means for calculating a number of rescues at which the car is landed on each of the floors based upon the information from the operation mode selecting means and the number of the remaining persons on each of the floors;

rescue order deciding means for deciding a priority as to each of the floors based upon the information from the fire occurrence floor specifying means;

waiting time calculating means for calculating a waiting time in each of the floors based upon the information from the rescue count calculating means and the rescue order deciding means; and judging means for comparing the evacuation operation times with the waiting time sequentially from the respective floors having higher orders based upon the information from the evacuation time calculating means, the rescue order deciding means, and the waiting time calculating means to determine the rescue target floor from which the remaining persons are rescued, and a rescue prohibited floor from which rescuing of the remaining persons is prohibited for each of the floors; and the schedule deciding means decides the evacuation operation schedule in such a manner that at least the number of the remaining persons, the rescue count, and the waiting time as to the rescue target floor are included in the evacuation operation schedule.

4. The fire emergency control operation system for an elevator according to claim 2, wherein:

an evacuation operation in-car switch, for specifying any one of the elevator machines as an instructed elevator machine is provided in each of the cars; and the elevator control means controls the operations of all the elevator machines based upon a manipulation of an operation button used in the car in the instructed elevator machine in a case of the train type operation mode, whereas the elevator control means controls only the operations of the part of the elevator machines including the instructed elevator machine based upon a manipulation of an operation button used in the car in the instructed elevator machine in a case of the taxi type operation mode.

5. The fire emergency control operation system for an elevator according to claim 4, wherein in the case of the train type operation mode, the elevator control means controls the operations of the elevators in such a manner that based upon the manipulation of the operation button in the instructed elevator machine, the elevator control means performs door closing operations of elevator entrances of the elevator machines other than the instructed elevator machine, and after the door closing operations are completed, the door closing operation of the elevator entrance of the instructed elevator machine is carried out.

6. The fire emergency control operation system for an elevator according to claim 1, wherein the elevator control means controls the operations of the elevators in such a manner that when the car is landed on the floor, a door opening operation of the elevator entrance is carried out only in a case where the operation button provided in the car is manipulated.

7. The fire emergency control operation system for an elevator according claim 1, wherein the display means includes an in-car display apparatus provided in the car of the elevator.

8. The fire emergency control operation system for an elevator according to claim 1, wherein the fire emergency control operation system further comprises an evacuation operation control switch for selecting whether or not the evacuation operation is applied, and wherein the elevator control means controls the operations of the elevators based upon the information of the evacuation operation schedule only when the application of the evacuation operation is selected by manipulating the evacuation operation control switch.

9. The fire emergency control operation system for an elevator according to claim 1, wherein:

the elevator includes a scaling apparatus for detecting a weight in the car;

the elevator control means transfers information of the weight detected by the scaling apparatus to the schedule deciding means; and the schedule deciding means calculates a total number of the remaining persons conveyed to the evacuation floor based upon the information from the elevator control means, and updates the evacuation operation schedule based upon the calculated total number of the remaining persons.

10. The fire emergency control operation system for an elevator according to claim 1, wherein an elevator hall notification apparatus for notifying the content of the evacuation operation schedule is provided on each of the floors.

11. The fire emergency control operation system for an elevator according to claim 3, wherein:

an evacuation operation in-car switch, for specifying any one of the elevator machines as an instructed elevator machine is provided in each of the cars; and the elevator control means controls the operations of all the elevator machines based upon a manipulation of an operation button used in the car in the instructed elevator machine in a case of the train type operation mode, whereas the elevator control means controls only the operations of the part of the elevator machines including the instructed elevator machine based upon a manipulation of an operation button used in the car in the instructed elevator machine in a case of the taxi type operation mode.

12. The fire emergency control operation system for an elevator according to claim 11, wherein in the case of the train type operation mode, the elevator control means controls the operations of the elevators in such a manner that based upon the manipulation of the operation button in the instructed elevator machine, the elevator control means performs door closing operations of elevator entrances of the elevator machines other than the instructed elevator machine, and after the door closing operations are completed, the door closing operation of the elevator entrance of the instructed elevator machine is carried out.

* * * * *